US010134209B2

(12) United States Patent
Favier et al.

(10) Patent No.: US 10,134,209 B2
(45) Date of Patent: Nov. 20, 2018

(54) SYSTEM AND METHOD FOR MANAGING THE UNLOCKING OF AN ANTI-THEFT DEVICE

(71) Applicant: EXAQTWORLD, Joinville le Pont (FR)

(72) Inventors: Alain Favier, Nogent sur Marne (FR); Tamas Lodi, Budapest (HU)

(73) Assignee: EXAQTWORLD, Joinville le Pont (FR)

( * ) Notice: Subject to any disclaimer, the term of this patent is extended or adjusted under 35 U.S.C. 154(b) by 0 days.

(21) Appl. No.: 14/414,240

(22) PCT Filed: May 3, 2013

(86) PCT No.: PCT/FR2013/051000
§ 371 (c)(1),
(2) Date: Jan. 12, 2015

(87) PCT Pub. No.: WO2014/009617
PCT Pub. Date: Jan. 16, 2014

(65) Prior Publication Data

US 2015/0187150 A1 Jul. 2, 2015

(30) Foreign Application Priority Data

Jul. 12, 2012 (FR) ..... 12 56750

(51) Int. Cl.
*E05B 73/00* (2006.01)
*G07C 9/00* (2006.01)
(Continued)

(52) U.S. Cl.
CPC ..... *G07C 9/00111* (2013.01); *E05B 73/0017* (2013.01); *E05B 73/0047* (2013.01);
(Continued)

(58) Field of Classification Search
CPC ..... E05B 73/0047; E05B 73/0052; E05B 73/0064
See application file for complete search history.

(56) References Cited

U.S. PATENT DOCUMENTS 2,087,372 A * 7/1937 Crawford ..... D04B 17/04 223/109 R
4,527,310 A * 7/1985 Vandebult ..... E05B 73/0017 24/136 R
(Continued)

FOREIGN PATENT DOCUMENTS

EP 1 505 551 A2 2/2005
FR 2 942 835 A1 9/2010
(Continued)

OTHER PUBLICATIONS

International Search Report, dated Dec. 18, 2013, from corresponding PCT application.

*Primary Examiner* — Benyam Haile
(74) *Attorney, Agent, or Firm* — Ipsilon USA, LLP

(57) ABSTRACT

A system for managing the unlocking of a device for identifying a commercial item includes at least two elements capable of assuming a locked position in which they enclose the article between them, and an unlocked position. The system includes a device for unlocking the identification device, elements for preventing unlocking, which are activated, and decision elements for deciding whether to deactivate or not deactivate the elements for preventing unlocking. The decision elements are capable of deciding on the basis of the identification or lack of identification of the association of the identification device and the commercial item to which the device is attached.

22 Claims, 15 Drawing Sheets

(51) Int. Cl.

| | |
|---|---|
| *G07G 3/00* | (2006.01) |
| *G07G 1/00* | (2006.01) |
| *G08B 13/24* | (2006.01) |

(52) U.S. Cl.

CPC ..... *E05B 73/0064* (2013.01); *G07G 1/0036* (2013.01); *G07G 1/0045* (2013.01); *G07G 1/0054* (2013.01); *G07G 3/003* (2013.01); *G08B 13/246* (2013.01); *G08B 13/2417* (2013.01); *G08B 13/2431* (2013.01); *G08B 13/2434* (2013.01); *Y10T 24/50* (2015.01); *Y10T 70/5004* (2015.04)

(56) References Cited

U.S. PATENT DOCUMENTS

| | | | | |
|---|---|---|---|---|
| 5,942,978 | A | 8/1999 | Shafer | |
| 5,955,951 | A * | 9/1999 | Wischerop | E05B 73/0017 340/10.42 |
| 6,598,790 | B1 | 7/2003 | Horst | |
| 6,693,511 | B1 | 2/2004 | Seal | |
| 2003/0135417 | A1 | 7/2003 | Bodin | |
| 2004/0044580 | A1 | 3/2004 | Haller | |
| 2005/0190060 | A1 | 9/2005 | Clancy et al. | |
| 2008/0291029 | A1 | 11/2008 | Skjellerup et al. | |
| 2012/0011904 | A1 | 1/2012 | Favier | |
| 2014/0055249 | A1 * | 2/2014 | Garner | G07G 1/0045 340/10.51 |

FOREIGN PATENT DOCUMENTS

| | | | |
|---|---|---|---|
| KR | 20040079625 | A | 9/2004 |
| WO | 91/13416 | A1 | 9/1991 |
| WO | 2006/050407 | A1 | 5/2006 |
| WO | 2008/056093 | A1 | 5/2008 |
| WO | 2008/069643 | A1 | 6/2008 |
| WO | 2008093293 | A2 | 8/2008 |

* cited by examiner

SYSTEM AND METHOD FOR MANAGING THE UNLOCKING OF AN ANTI-THEFT DEVICE

The invention relates to a system and to a method for managing the unlocking of an identification device of a commercial article, packaged or not, and which is fixed to the article or to its packaging in a locked manner.

The sector of the in-shop sale of commercial articles suffers from several types of losses of earnings grouped together under the term "Unknown Shrinkage" or US. US is divided into three parts:

- external theft (customers) which represents from 30 to 40% of US and is characterized by ill-intentioned customers leaving the shop with unpaid for articles or who change the prices or percentages of discount before going to the checkout till;
- internal theft (employees) which represents from 30 to 50% of US and is characterized by ill-intentioned employees who either remove the antitheft tags (such as resonant tags) from the articles since they have access to the unlocking or deactivation systems or do not encash all or part of the amount for the articles discounted to someone else of their acquaintance (fraudulent checkout);
- administrative errors, checkout errors and inventory discrepancies which represent the remainder of the US.

In order to combat US, shops have hitherto used video surveillance, watchmen and/or antitheft tags attached to articles which trigger an alarm when passing between the antitheft gantries placed at the entrances and exits of shops if they have not previously been removed at the checkout till.

However, antitheft tags are not effective in combating internal theft since employees have direct access to the checkout tills and to the unlocking or deactivation systems.

Moreover, when the antitheft tags are formed of two parts, one part of which is a stud, the management of these two unlocked and separated parts turns out to be arduous for the shop staff, in particular at the checkout tills where the tags are unlocked.

Neither is video surveillance effective enough in combating internal theft because of a relatively reduced surveillance staff for monitoring the video screens, of a large number of people to be monitored in large shops and of dead angles that the cameras cannot reach.

Watchmen, for their part, are not reliable and can only monitor a limited number of people.

Furthermore, the aforementioned systems are not effective in case of an ill-intentioned person substituting a price label of an article with that of another article and when a checkout till employee scans a low-price article and sells, to a person of their choice, one or more higher-price articles.

According to a first aspect, the invention is aimed at a system for managing the unlocking of an identification device of a packaged or unpackaged commercial article, characterized in that the system comprises:

- an identification device of a packaged or unpackaged commercial article, the device comprising at least two elements which are displaceable with respect to one another between two positions, a locked position, in which said at least two elements imprison between them, in a locked manner under the action of locking means, the article or its packaging, and at least one unlocked position, the identification device bearing information identifying said device and/or the commercial article to which said device is fixed,

- means for identifying the association of the identification device and of the commercial article to which said device is fixed,
- an unlocking device comprising an unlocking zone and unlocking means for unlocking, with respect to one another, said at least two elements of the identification device and freeing the article or its packaging of said identification device,
- means for preventing the unlocking of the identification device which are able, on the one hand, to be activated so as to prevent the unlocking of the identification device and, on the other hand, to be deactivated so as to permit the unlocking of the identification device,
- means for deciding deactivation or non-deactivation of the means for preventing the unlocking of the identification device as a function of the identification or of the absence of identification of the association of the identification device and of the commercial article to which said device is fixed.

The means for preventing the unlocking of the identification device are activated by default so as to control access to the unlocking zone and are deactivated only under certain conditions. The presence of these means makes it possible not to be able easily to unlock an identification device and thus to free an article which is fixed in a locked manner to the device.

Moreover, the means for preventing unlocking are deactivated when it is possible to identify in a secure and reliable manner the device which is permitted to be unlocked and therefore the article/physical object with which it is associated. The identification of the association of this device and of the article to which it is fixed makes it possible to uniquely identify the identification device-commercial article pair. The identification of the identification device-commercial article pair is for example performed by virtue of the identification information borne by the device and which is for example read from the device. This information can directly identify the identification device-commercial article association or the device alone. It then suffices to verify in the shop's computing system that the device thus identified is properly associated with the commercial article in question. Any fraud can thus be pinpointed easily.

With the principle of reading the barcode of labels, when several identical articles are purchased the member of staff at the checkout till scans just one of the barcodes and thereafter multiplies on the screen of their checkout till the identification of the article scanned by the number of articles instead of scanning all the articles one by one. An error when inputting the number of articles may generate checkout errors and therefore a financial loss for the shop.

The system according to the first aspect of the invention makes it essential on the contrary to previously make sure of the identity of each identification device-commercial article pair (for example by reading the identification information borne by the identification device) before permitting access to the unlocking zone.

This makes it possible to avoid errors of input such as those mentioned hereinabove.

The system thus makes it possible to combat internal theft and inventory discrepancies.

According to other characteristics taken in isolation or in combination with one another:

- the system comprises means for activating and deactivating the means for preventing unlocking; these means are thus controlled as a function of the identification or of the absence of identification of the identification device-commercial article association;

the means for preventing unlocking are mechanical means which prevent physical access of the identification device to the unlocking zone of the unlocking device; it is thus possible to prevent or restrict access to at least one part of the unlocking device such as the unlocking zone; according to a variant, it is also conceivable to leave access to this zone free but to prevent the activation (or deactivation) of the unlocking means;

the mechanical means for preventing unlocking comprise one or more mobile blocking members which are able to occupy, on the one hand, a deployed position preventing physical access of the identification device to the unlocking zone of the unlocking device and, on the other hand, a retracted position permitting physical access of the identification device to the unlocking zone of the unlocking device;

the system comprises blocking means which are able to block in a blocking position, in the unlocking zone of the unlocking device, said unlocked identification device or one of said at least two unlocked elements of said identification device; when the article is freed from the identification device (e.g.: antitheft tag) after unlocking, there still remains blocked in the unlocking (reception) zone either one of the two elements of the device when the latter is formed of two separable elements and when the other element has been withdrawn after unlocking and freeing of the article, or the device itself when it is made in one piece and when the two elements are merely mutually mobile parts of the device (for example the two elements are clamping members forming claws to clasp the article and the device comprises a clamping mechanism implemented under the action of an actuation member (e.g.: thumbwheel) and a locking mechanism (means) to prevent any subsequent clamping onward of a predetermined clamping couple exerted by the two members on the article; such a device is described in patent application FR 2 942 835); the blocking, in the unlocking zone, of the identification device or of one of its elements makes it possible to ensure that the device will not be free to leave the place of unlocking because of the mere fact that unlocking has occurred. Deblocking can occur after satisfaction of a predetermined condition. For example, deblocking can occur after verification of the identification of the device. Indeed, the identification device has previously been associated (e.g.: in the computing system of the shop) with the article to which it has been fixed. It is thus verified whether the device or the element blocked in the unlocking device (e.g.: decoupler) corresponds to the freed article to which it had previously been assigned. This verification makes it possible to ensure that there has been no fraud; this makes it possible to improve the management of identification devices in the form of two elements;

the system comprises means for activating, in a blocking position, and for deactivating as a function of a predetermined condition, in an deblocking position, the means for blocking the identification device or one of said at least two elements blocked in the unlocking zone;

the blocking means comprise the mobile blocking member or members of the mechanical means for preventing unlocking;

the means for activating and deactivating the mobile blocking member or members comprise a mechanism for displacing the mobile blocking member or members;

the displacement mechanism comprises a motor cooperating with a toothed wheel for driving the latter in rotation, a component mounted so as to be integral in rotation with the toothed wheel and comprising a contact portion, the mobile member or members cooperating by contact with the contact portion of said component by way of a cam means so that the rotation of the wheel drives the displacement of the mobile blocking member or members;

the unlocking device comprises a mobile part surrounding the unlocking zone and which is able to occupy two positions, namely a top blocking position in which the mobile part is situated at a height above or equal to the height of the identification device or of one of said at least two elements disposed in said unlocking zone and a bottom deblocking position in which the mobile part is situated at a height below the height of the identification device or of the element disposed in said unlocking zone;

the system comprises a mechanism for displacing the mobile part which is able to be activated as a function of a predetermined condition;

the mechanism for displacing the mobile part comprises a motor cooperating with a toothed wheel for driving the latter in rotation, a component mounted so as to be integral in rotation with the toothed wheel and comprising a first cam means, the mobile part comprising a second cam means complementary to the first cam means and cooperating with said component by way of the two cam means so that the rotation of the wheel drives the vertical displacement of the mobile part from one position to the other;

the system comprises means for reading identification information borne by said device, the means for deciding deactivation or non-deactivation of the means for preventing the unlocking of the identification device also being able to be deactivated or not deactivated as a function of the identification information read; the reading of the information borne by the identification device makes it possible to circumvent the reading of the barcode of the label which is generally attached to the commercial article; it is relatively easy to falsify the price of an article on a label, this not being the case for an identification device whose identification information is not accessible to a user from outside the device; more particularly, the device which is permitted to be unlocked is a device whose identification information has already been read a first time and for which the commercial article to which it is fixed has been settled up by a customer at the point of sale of the shop; the second reading of the identification information by the reading means and its comparison with that read during the first reading thus makes it possible to verify that the commercial article has been properly sold (and therefore that its price has been cashed up) before deciding to deactivate the means for preventing the unlocking of each device;

the identification information of the identification device and/or of the commercial article comprises at least one identification code;

said at least one identification code comprises at least one of the following identification codes: unique TID identifier of an RFID member integrated into the identification device, identification code of the commercial article (EAN, EPC) assigned to the physical object in the guise of commercial article, optical-reading code uniquely identifying the physical object to which said device is fixed and which is distinct from the identification code of the commercial article;

the identification information identifies the association of the identification device and of the commercial article to which said device is fixed;

the identification information comprises the association of a unique identification code of the identification device and of an identification code of the commercial article (EAN) to which the device is fixed, the identification device being fixed to a physical object bearing said commercial article identification code (EAN) which is assigned to all the identical physical objects;

the system comprises an association between the identification information of the identification device and/or of the commercial article to which said device is fixed and a URL address of a site or of a Web page dedicated to the commercial article;

the identification device comprises two separable elements, said two elements being separated from one another (the two elements are distanced one from the other) in an unlocked position and fixed to one another in the locked position;

the two elements are able to be fixed to one another, on the one hand, in the locked position for which they are arranged opposite one another according to an axial configuration and, on the other hand, in at least one unlocked position (other than that for which they are distanced one from the other) for which they are arranged according to at least one configuration shifted transversely with respect to the axial locking configuration;

a first of the two elements comprises a tip intended to pass through the article or its packaging, the second element being provided, in a first zone, with an orifice so as to insert axially thereinto, according to a first insertion axis, the tip and maintain it, under the action of the locking means, in the locked axial position so as to prevent its withdrawal, the second element also being provided with at least one second zone for receiving the tip which is shifted transversely with respect to the first zone and in which the tip is able to be inserted axially according to several insertion axes parallel to the first insertion axis, so as to obtain several distinct possible unlocked positions of the two elements, each unlocked position corresponding to a transversely shifted configuration of said two elements;

the system comprises detection means which are able to detect said at least one unlocked position of the two separable elements;

the detection means are electromagnetic detection means which comprise means for emitting at least one electromagnetic signal and means for receiving said at least one electromagnetic signal emitted, said emitting means and said receiving means being arranged around the unlocking zone in such a way that the transversely shifted configuration of the two separable elements affects the propagation of said at least one electromagnetic signal emitted between the emitting means and the receiving means;

the transversely shifted configuration of the two separable elements affects the propagation of said at least one electromagnetic signal emitted between the emitting means and the receiving means in a different manner from the locked axial configuration;

the emitting means and the receiving means comprise several pairs of emitting and receiving elements, the emitting elements of each pair being disposed opposite the receiving elements of the same pair;

the emitting elements of all the pairs are arranged in such a way that the set of the mean electromagnetic signals or electromagnetic beams emitted define a triangular region delimiting the unlocking zone;

the unlocking device comprises at least one permanent magnet which is able to magnetically unlock the two elements of the identification device that are locked together, the unlocking zone comprising means of mechanical stabilization of the identification device or of one of said at least two elements which are intended to stabilize said device according to a predetermined orientation, said predetermined orientation allowing the magnetic field generated by said at least one permanent magnet to magnetically unlock the two elements of the identification device;

the unlocking zone comprises a housing which is able to receive the identification device or one of said at least two elements and which has a shape and dimensions substantially complementary to those of said device or of the element, thus for example making it possible to ensure the mechanical stabilization of the device as set forth hereinabove (stabilizer); the housing has a sufficient depth so that the device or the element which is received therein cannot be extracted from the housing without aid;

the identification device of a commercial article is a device for protection against the theft of this article;

the device for protection against theft comprises at least one active or passive member which is able to emit toward the exterior of the device or to receive electromagnetic waves from the exterior.

The invention is also aimed at a method for managing the unlocking of an identification device of a packaged or unpackaged commercial article, the device comprising at least two elements which, in a locked position, imprison between them the article or its packaging, characterized in that, the identification device bearing information identifying said device and/or the commercial article to which it is fixed, the method comprises:

the prevention of the unlocking, in an unlocking zone of an unlocking device, of said at least two elements of the identification device with respect to one another, the identifying of the association of the identification device and of the commercial article to which said device is fixed, the deciding of deactivation or non-deactivation of the prevention of the unlocking of the identification device and of freeing of the article or of its packaging as a function of the identification or of the absence of identification of the association of the identification device and of the commercial article to which said device is fixed.

The same advantages as those presented in relation to the system apply to the method mentioned hereinabove and will therefore not be repeated.

According to other characteristics taken in isolation or in combination with one another:

the method comprises a step of activating and deactivating the prevention of unlocking;

the prevention of unlocking is a prevention of physical access of the identification device to the unlocking zone of the unlocking device;

the step of activating the prevention of unlocking comprises a step of deploying one or more mobile blocking members in a deployed position preventing physical access of the identification device to the unlocking zone of the unlocking device;

the method comprises a step of blocking, in the unlocking zone of the unlocking device, the identification device or one of said at least two elements in such a way that, after unlocking of said at least two elements and freeing of the article or of its packaging, said device or one of said at least two elements is blocked in said unlocking zone;

the blocking step comprises a step of deploying one or more mobile blocking members in a blocking position of the device or of one of said at least two elements in the unlocking zone;

the method comprises a step of deblocking the identification device or one of said at least two elements blocked in the unlocking zone as a function of a predetermined condition;

the unlocking device comprising a mobile part surrounding the unlocking zone, the method comprises a step of displacing the mobile part between, on the one hand, a top blocking position in which the mobile part is situated at a height above or equal to the height of the identification device or of one of said at least two elements disposed in said unlocking zone and, on the other hand, a bottom deblocking position in which the mobile part is situated at a height below the height of the identification device or of the element disposed in said unlocking zone;

the method comprises the reading of identification information borne by the identification device, the deciding of deactivation or non-deactivation of the prevention of the unlocking of the identification device and of freeing of the article or of its packaging also being performed as a function of the information read;

the identification information of the identification device and/or of the commercial article comprises at least one identification code;

said at least one identification code comprises at least one of the following identification codes: unique TID identifier of an RFID member integrated into the identification device, identification code of the commercial article (EAN, EPC) assigned to the physical object in the guise of commercial article, optical-reading code uniquely identifying the physical object to which said device is fixed and which is distinct from the identification code of the commercial article;

the identification information identifies the association of the identification device and of the commercial article to which said device is fixed;

the identification information comprises the association of a unique identification code of the identification device and of an identification code of the commercial article (EAN) to which the device is fixed, the identification device being fixed to a physical object bearing said commercial article identification code (EAN) which is assigned to all the identical physical objects;

the method comprises a prior step of association between the identification information of the identification device and/or of the commercial article to which said device is fixed and a URL address of a site or of a Web page dedicated to the commercial article;

the identification device comprises two separable elements, said two elements being separated from one another in an unlocked position and fixed to one another in the locked position;

the two elements are able to be fixed to one another, on the one hand, in the locked position for which they are arranged opposite one another according to an axial configuration and, on the other hand, in at least one unlocked position for which they are arranged according to at least one configuration shifted transversely with respect to the axial locking configuration;

a first of the two elements comprises a tip intended to pass through the article or its packaging, the second element being provided, in a first zone, with an orifice so as to insert axially thereinto, according to a first insertion axis, the tip and maintain it, under the action of the locking means, in the locked axial position so as to prevent its withdrawal, the second element also being provided with at least one second zone for receiving the tip which is shifted transversely with respect to the first zone and in which the tip is able to be inserted axially according to several insertion axes parallel to the first insertion axis, so as to obtain several distinct possible unlocked positions of the two elements, each unlocked position corresponding to a transversely shifted configuration of said two elements;

the method comprises a step of detecting said at least one unlocked position of the two separable elements;

the detection step comprises the following sub-steps:

emission of at least one electromagnetic signal in the unlocking zone and/or around said zone, reception of said at least one electromagnetic signal emitted, on the basis of said at least one electromagnetic signal received, detection of said at least one unlocked position of the two separable elements as a function of the affecting of the propagation of said at least one signal emitted by the transversely shifted configuration of the two separable elements;

the detection of said at least one second unlocked position of the two separable elements is also performed as a function of the affecting of the propagation of said at least one electromagnetic signal emitted by the locked axial configuration of the two separable elements;

the identification device of a commercial article is a device for protection against the theft of this article;

the device for protection against theft comprises at least one active or passive member which is able to emit toward the exterior of the device or to receive electromagnetic waves from the exterior.

According to a second aspect, the invention is aimed at a method for detecting the presence of an identification device of a commercial article, an identification device of a commercial article being locked to the commercial article or to its packaging and having to be unlocked by an unlocking device which comprises an unlocking zone intended to receive the identification device to be unlocked, characterized in that the method comprises a step of detecting the presence of possible other identification devices of commercial articles in proximity to the unlocking zone of the unlocking device. The detection of the presence of other devices at the moment at which it is desired to unlock a device fixed to an article makes it possible to avoid subsequent malfunctions by merging, in the computing system of the shop, one of the devices detected in proximity with the device to be unlocked. Thus, in case of detection of at least one other device (for example left inadvertently by the member of staff present at the checkout till of the shop) the unlocking method can be halted and/or an alarm can be triggered.

It will be noted that the characteristics set forth hereinabove in relation to the management system or to the unlocking device can apply to this other aspect of the invention.

According to other characteristics taken in isolation or in combination with one another:

- each identification device of a commercial article bearing identification information, the method comprises a step of reading information identifying possible identification devices of commercial articles situated in proximity to the unlocking zone of the unlocking device; it will be noted that the detection/reading can be performed although the device to be unlocked is not yet in the unlocking zone; for example, in case of detection of at least one other device in proximity to the unlocking zone, access to this zone can be blocked;
- the reading can be performed by radiofrequencies, each commercial article identification device comprising at least one member of RFID type and/or an optical-reading code such as a code of QR type bearing identification information of the device (and optionally the article).

According to a third aspect, the invention is aimed at a system for managing the unlocking of an identification device of a packaged or unpackaged commercial article, characterized in that the system comprises:

- an identification device of a packaged or unpackaged commercial article, the device comprising at least two elements which are displaceable with respect to one another between two positions, a locked position, in which said at least two elements imprison between them, in a locked manner under the action of locking means, the article or its packaging, and at least one unlocked position, the identification device bearing information identifying said device and/or the commercial article to which said device is fixed,
- means for identifying the association of the identification device and of the commercial article to which said device is fixed,
- an unlocking device comprising an unlocking zone and, in said zone:
- unlocking means for unlocking, with respect to one another, said at least two elements of the identification device and freeing the article or its packaging of said identification device,
- blocking means which are able to be activated so as to block at least one of the two elements after unlocking of the latter with respect to one another and freeing of the article or of its packaging, said blocking means being able to be deactivated as a function of the realization of a predetermined condition.

Unlocking is thus performed without prevention or control. However, the device or one of the elements of the latter, if it is in the form of several separable elements, remains held in the unlocking zone.

The blocking, in the unlocking zone, of the identification device or of one of its elements makes it possible to ensure that the device will not be free to leave the place of unlocking because of the mere fact that unlocking has occurred. Deblocking can occur after satisfaction of a predetermined condition. For example, deblocking can occur after verification of the identity of the device. Indeed, the identification device has previously been associated (e.g.: in the computing system of the shop) with the article to which it has been fixed. It is thus verified whether the device or the element blocked in the unlocking device (e.g.: decoupler) corresponds to the freed article to which it had previously been assigned. This verification makes it possible to ensure that there has been no fraud.

According to other possible characteristics, taken in isolation or in combination with one another:

- said at least two elements of the identification device are two separable elements which are able to be fixed to one another, on the one hand, in the locked position and, on the other hand, in said at least one unlocked position;
- the blocking means are able to be deactivated or not as a function of the identification information borne by one of the two elements when the two separable elements are in said at least one unlocked position;
- the two separable elements are able to be fixed to one another, on the one hand, in the locked position in which they are arranged opposite one another according to an axial configuration and, on the other hand, in said at least one unlocked position for which they are arranged according to at least one configuration shifted transversely with respect to the axial locking configuration;
- a first of the two elements comprises a tip intended to pass through the article or its packaging, the second element being provided, in a first zone, with an orifice so as to insert axially thereinto, according to a first insertion axis, the tip and maintain it, under the action of the locking means, in the locked axial position so as to prevent its withdrawal, the second element also being provided with at least one second zone for receiving the tip which is shifted transversely with respect to the first zone and in which the tip is able to be inserted axially according to several insertion axes parallel to the first insertion axis, so as to obtain several distinct possible unlocked positions of the two elements, each unlocked position corresponding to a transversely shifted configuration of said two elements;
- the system comprises detection means which are able to detect said at least one unlocked position of the two separable elements;
- the detection means are electromagnetic detection means which comprise means for emitting at least one electromagnetic signal and means for receiving said at least one electromagnetic signal emitted, said emitting means and said receiving means being arranged around the unlocking zone in such a way that the transversely shifted configuration of the two separable elements affects the propagation of said at least one electromagnetic signal emitted between the emitting means and the receiving means;
- the transversely shifted configuration of the two separable elements affects the propagation of said at least one electromagnetic signal emitted between the emitting means and the receiving means in a different manner from the locked axial configuration;
- the emitting means and the receiving means comprise several pairs of emitting and receiving elements, the emitting elements of each pair being disposed opposite the receiving elements of the same pair;
- the emitting elements of all the pairs are arranged in such a way that the set of the mean electromagnetic signals or electromagnetic beams emitted define a triangular region delimiting the unlocking zone;
- the unlocking zone comprises a housing which is able to receive the identification device or one of said at least two elements and which has a shape and dimensions substantially complementary to those of said device or of the element;

the identification device of a commercial article is a device for protection against the theft of this article;

the device for protection against theft comprises at least one active or passive member which is able to emit toward the exterior of the device or to receive electromagnetic waves from the exterior.

The invention is also aimed at a method for managing the unlocking of an identification device of a packaged or unpackaged commercial article, the device comprising at least two elements which are displaceable with respect to one another between two positions, a locked position, in which said at least two elements imprison between them, in a locked manner under the action of locking means, the article or its packaging, and at least one unlocked position, the identification device bearing information identifying said device and/or the commercial article to which said device is fixed, characterized in that the method comprises:

the identifying of the association of the identification device and of the commercial article to which said device is fixed, the unlocking, in an unlocking zone of an unlocking device, of said at least two elements of the identification device with respect to one another and the freeing of the article or of its packaging of said identification device, the blocking, in the unlocking zone, of at least one of the two elements after their unlocking, the deblocking of said at least one of the two elements as a function of the realization of a predetermined condition.

The same characteristics and advantages as those of the system apply to the method and will therefore not be repeated here.

According to a fourth aspect, the invention is aimed at a system for managing the unlocking of an identification device of a packaged or unpackaged commercial article, characterized in that the system comprises:

an identification device of a packaged or unpackaged commercial article, the device comprising two separable elements which are able to be fixed to one another, on the one hand, in a locked position in which the two elements imprison between them, in a locked manner under the action of locking means, the article or its packaging and, on the other hand, at least one unlocked position, an unlocking device comprising a housing which is able to receive the identification device, or one of its elements, in the locked and unlocked position and unlocking means for unlocking, with respect to one another, the two elements of the identification device and free the article or its packaging of said identification device, detection means which are able to detect said at least one unlocked position of the identification device in which the two elements of said identification device are fixed to one another when said identification device or one of its elements is received in the housing in said at least one unlocked position.

The fact of refixing, in an unlocked position, one of the two elements with the other element held in the housing (it may for example be blocked in this housing) makes it possible to ensure that the two elements will remain paired and that they will not be disunited. Moreover, such a repositioning of one of the elements which has been withdrawn after unlocking and freeing of the article makes it possible to facilitate the withdrawal of the other element from out of the housing. It will be noted that the detection of a shifted position makes it possible to be assured of the proper pairing of the two elements and of the fact that they are ready to be withdrawn from the unlocking zone.

The detection of a shifted position can also be accompanied by the identification of the device, in particular of the element which has been withdrawn after unlocking and freeing of the article and which is repositioned on the other element. Thus, one is assured that the same two elements of the device remain paired and will be recycled together.

According to other possible characteristics, taken in isolation or in combination with one another:

the detection means are able to detect said at least one unlocked position of the identification device by comparison with the detection of the locked position of said device;

the detection means are electromagnetic detection means which comprise means for emitting at least one electromagnetic signal and means for receiving said at least one electromagnetic signal emitted, said emitting means and said receiving means being arranged around the unlocking zone in such a way that the transversely shifted configuration of the two separable elements affects the propagation of said at least one electromagnetic signal emitted between the emitting means and the receiving means;

the transversely shifted configuration of the two separable elements affects the propagation of said at least one electromagnetic signal emitted between the emitting means and the receiving means in a different manner from the locked axial configuration;

the emitting means and the receiving means comprise several pairs of emitting and receiving elements, the emitting elements of each pair being disposed opposite the receiving elements of the same pair;

the emitting elements of all the pairs are arranged in such a way that the set of the middle electromagnetic signals or electromagnetic beams emitted by said elements define a triangular region delimiting the unlocking zone; this arrangement exhibits high detection sensitivity;

the emitting and receiving means are arranged so as to leave free between them a passage for the intake of an identification device in the unlocking zone; such an arrangement facilitates the intake of an identification device in the unlocking zone;

the housing which is able to receive the identification device or one of the two elements has a shape and dimensions substantially complementary to those of said device or of the element that it receives;

the identification device of a commercial article is a device for protection against the theft of this article;

the device for protection against theft comprises at least one active or passive member which is able to emit toward the exterior of the device or to receive electromagnetic waves from the exterior.

The invention is also aimed at a method for managing the unlocking of an identification device of a packaged or unpackaged commercial article, the device comprising two separable elements which are able to be fixed to one another, on the one hand, in a locked position in which the two elements imprison between them, in a locked manner under the action of locking means, the article or its packaging and, on the other hand, at least one unlocked position, characterized in that the method comprises:

the reception of the identification device, or of one of its elements, in the locked position in a housing of an unlocking device, the unlocking, with respect to one another, of the two elements of the identification device and the withdrawal of a first element so as to allow the freeing of the article or of its packaging of said identification device, while the second element is maintained in the housing, the putting in place of the first element fixed to the second element in said at least one unlocked position of the identification device, the detection of said at least one unlocked position of the identification device.

The same characteristics and advantages as those of the system apply to the method and will therefore not be repeated here.

According to a fifth aspect, the invention is aimed at a system for managing the unlocking of an identification device of a packaged or unpackaged commercial article, characterized in that the system comprises:

an identification device of a packaged or unpackaged commercial article, the device comprising at least two elements which are displaceable with respect to one another between two positions, a locked position, in which said at least two elements imprison between them, in a locked manner under the action of locking means, the article or its packaging, and at least one unlocked position, an unlocking device comprising:

unlocking means for unlocking, with respect to one another, said at least two elements of the identification device and freeing the article or its packaging of said identification device, an unlocking zone which comprises a part forming a housing for receiving the identification device or one of said at least two elements, a peripheral part surrounding said part forming a housing, a first of the two parts being vertically mobile with respect to the second fixed part so as to occupy two positions, namely a blocking position in which the peripheral part is situated at a height above or equal to the height of the identification device or of one of said at least two elements disposed in the part forming a housing, and an deblocking position in which the peripheral part is situated at a height below that of the identification device or of the element disposed in the part forming a housing.

The design and implementation of such a mechanism are particularly simple. Indeed, it does not make it necessary to displace for example the permanent magnet or magnets of the unlocking device which are generally unwieldy and therefore require robust actuators dimensioned accordingly and correspondingly appropriate electrical consumption. In the aforementioned system, only the part forming a housing for the device or the peripheral part surrounding said part forming a housing is mobile so as to adopt, in the blocking position, a position in which the identification device or one of said at least two elements disposed in the part forming a housing is set back vertically with respect to the peripheral part surrounding it.

According to other possible characteristics, taken in isolation or in combination with one another:

the system comprises a mechanism for displacing the mobile part which is able to be activated as a function of a predetermined condition;

the mechanism for displacing the mobile part comprises a motor cooperating with a toothed wheel for driving the latter in rotation, a component mounted so as to be integral in rotation with the toothed wheel and comprising a first cam means, the mobile part comprising a second cam means complementary to the first cam means and cooperating with said component by way of the two cam means so that the rotation of the wheel drives the vertical displacement of the mobile part from one position to the other; such a mechanism is particularly robust and easily industrializable; this system is moreover relatively precise in its displacement;

the mobile part is the peripheral part or the part forming a housing;

the system comprises mechanical means which prevent physical access of the identification device to the part forming a housing of the unlocking device;

the mechanical means for preventing access comprise one or more mobile blocking members which are able to occupy, on the one hand, a deployed position preventing physical access of the identification device to the part forming a housing of the unlocking device and, on the other hand, a retracted position permitting physical access of the identification device to the part forming a housing of the unlocking device;

the system comprises blocking means which are able to block in a blocking position, in the part forming a housing of the unlocking device, said unlocked identification device or one of said at least two unlocked elements of said identification device;

the system comprises means for activating, in a blocking position, and for deactivating as a function of a predetermined condition, in an deblocking position, the means for blocking the identification device or one of said at least two elements blocked in the part forming a housing;

the blocking means comprise the mobile blocking member or members of the mechanical means for preventing access;

the means for activating and deactivating the mobile blocking member or members comprise a mechanism for displacing the mobile blocking member or members;

the displacement mechanism comprises a motor cooperating with a toothed wheel for driving the latter in rotation, a component mounted so as to be integral in rotation with the toothed wheel and comprising a contact portion, the mobile member or members cooperating by contact with the contact portion of said component by way of a cam means so that the rotation of the wheel drives the displacement of the mobile blocking member or members. Such a mechanism is particularly robust and easily industrializable. This system is moreover relatively precise in its displacement. The assembly of the two aforementioned displacement mechanisms affords the assembly a general form of robust rotary block. The various motions are obtained by selective and independent rotation of one of the parts of this rotary block on the basis of two distinct motors (the motors are housed in a manner adjacent to the block so as to reduce the overall bulkiness of the decoupler).

According to a sixth aspect, the invention is aimed at a system for managing a transaction relating to the purchase of a commercial article and for unlocking an identification device of the commercial article to which the device is fixed, characterized in that the system comprises:

an identification device of a commercial article which is a packaged or unpackaged physical object, the device comprising at least two elements which are displaceable with respect to one another between two positions, a locked position, in which said at least two elements imprison between them, in a locked manner under the action of locking means, the article or its packaging, and at least one unlocked position, at least one optical-reading code borne by the identification device and uniquely identifying the physical object to which the device is fixed, said at least one optical-reading code being associated with the commercial article by a commercial article code (EAN), said at least one optical-reading code being representative of a URL address of a site or of a Web page dedicated to the commercial article, a mobile communication apparatus which is able to read said at least one optical-reading code and to establish a connection to the URL address with a view to performing the on-line purchase of the object, an unlocking device for unlocking, with respect to one another, said at least two elements of the identification device and freeing the article or its packaging of said identification device, means for managing the operation of the unlocking device which are able to manage the operation of said unlocking device as a function of the identification or of the non-identification of the identification device-physical object association established during the on-line purchase, means for dissociating said at least one optical-reading code and said URL address which are able to be activated after the unlocking and the withdrawal of the identification device from the unlocking device.

This system is an intelligent checkout and unlocking system which permits checkout and unlocking when the physical object in the guise of commercial article has been identified in a precise manner by virtue of the identification of the identification device-physical object association. This identification is for example performed by the identification of the association of an optical-reading code borne by the device to which the physical object is fixed and a commercial article code of the article (this code such as the EAN code is not necessarily unique for each copy of one and the same article such as a white polo shirt size T1 of the same brand and of the same model). This identification is performed in particular via the mechanism for connection to the URL address with a view to the on-line purchase of the object in the guise of commercial article.

This "fine" identification allows the transaction, on the one hand, and the unlocking, on the other hand, to be made secure.

Moreover, this management reduces waiting at the checkout tills of shops since the purchase of the physical object in the guise of commercial article is performed by the user via an electronic communication apparatus such as a smartphone or a tablet, therefore without having to pass via a till for checkout. Checkout errors are therefore also reduced.

By dissociating said at least one optical-reading code and said URL address after the unlocking and the withdrawal of the identification device from the unlocking device, one is thus assured of the recycling of said identification device. It can thus be reused with other commercial articles (specific EAN and specific URL) and said at least one optical-reading code will then be associated with these other specific EAN and specific URL.

All the other characteristics set forth above in relation to other aspects of the invention also apply to the system for managing a transaction and for unlocking presented hereinabove, as well as to the associated method presented hereinafter.

According to other possible characteristics taken in isolation or in combination with one another:

the mobile communication apparatus is able to read said at least one optical-reading code and to establish a connection to the URL address by way of an association table establishing an association between said at least one optical-reading code and said URL address; it will be noted that said at least one optical-reading code incorporates a string of alphanumeric characters which is decodable by a software application executable on the electronic communication apparatus (e.g.: smartphone or touchpad tablet) so as to make it possible to identify in a unique and secure manner the physical object in the guise of commercial article; the decoding makes it possible for example to access a secure memory area of a computing system in which is recorded a table of association between said at least one optical-reading code and the commercial article (commercial article code); this decoding allows the establishment of the secure connection with the URL address via the association table establishing an association between said at least one optical-reading code and said URL address;

the means for managing the operation of the unlocking device are able to manage the operation of said unlocking device, either to prevent access of the identification device to the unlocking device, or to retain the identification device after unlocking; thus, the functionalities of the unlocking device are controlled by the identification of the pair consisting of the identification device (e.g.: antitheft) and the physical object in the guise of commercial article, thereby securing checkout errors and fraud;

the identification device comprises an RFID member carrying a unique identification TID code and a commercial code of the article (EAN, EPC, etc.), the two codes being associated in the system.

The invention is also aimed at a method for managing a transaction relating to the purchase of a commercial article and for unlocking an identification device of the commercial article to which the device is fixed, characterized in that, the identification device of a commercial article, which is a packaged or unpackaged physical object, comprising at least two elements which are displaceable with respect to one another between two positions, a locked position, in which said at least two elements imprison between them, in a locked manner under the action of locking means, the article or its packaging, and at least one unlocked position, the identification device bearing at least one optical-reading code uniquely identifying the physical object to which the device is fixed, the method comprises:

the association between said at least one optical-reading code and a commercial article code (EAN) identifying the commercial article, said at least one optical-reading code being representative of a URL address of a site or of a Web page dedicated to the commercial article, the reading of said at least one optical-reading code and the establishing of a connection to the URL address with a view to performing the on-line purchase of the object, the management of the operation of a device for unlocking said at least two elements of the identification device as a function of the identification or of the non-identification of the identification device-physical object association established during the on-line purchase, the dissociation of said at least one optical-reading code and of said URL address after the unlocking and the withdrawal of the identification device from the unlocking device.

The method comprises the same advantages and the same characteristics as those presented in relation to the system hereinabove and they will not therefore be repeated.

Other characteristics and advantages will become apparent in the course of the description which follows, given solely by way of nonlimiting example and with reference to the appended drawings in which.

Figure 1A:
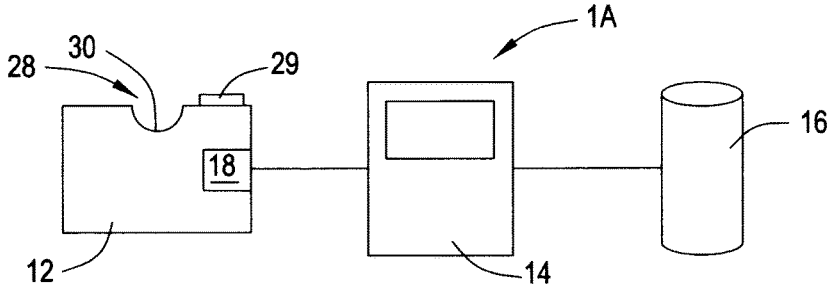
FIG. 1A is a schematic general view of an architecture of a system for managing the unlocking of identification devices according to an embodiment of the invention.
Figure 1B:
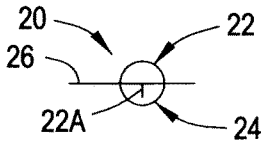
FIGS. 1B and 1C illustrate respectively an identification device in the position locked to an article and in the unlocked position.
Figure 1C:
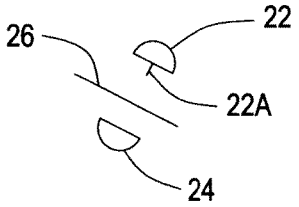
Figure 10A:
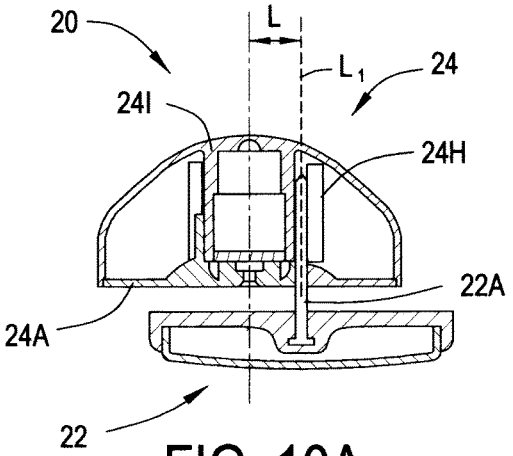
Figure 10B:
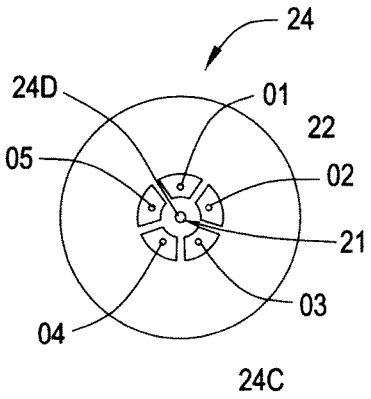
Figure 10C:
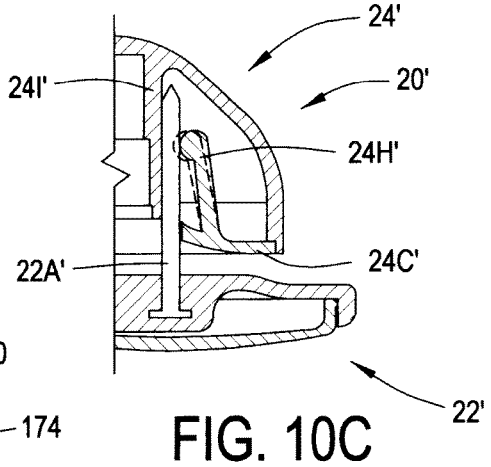
Figure 11:
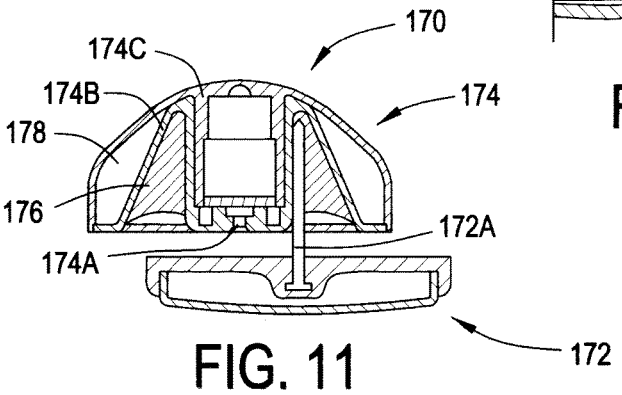
Figure 12:
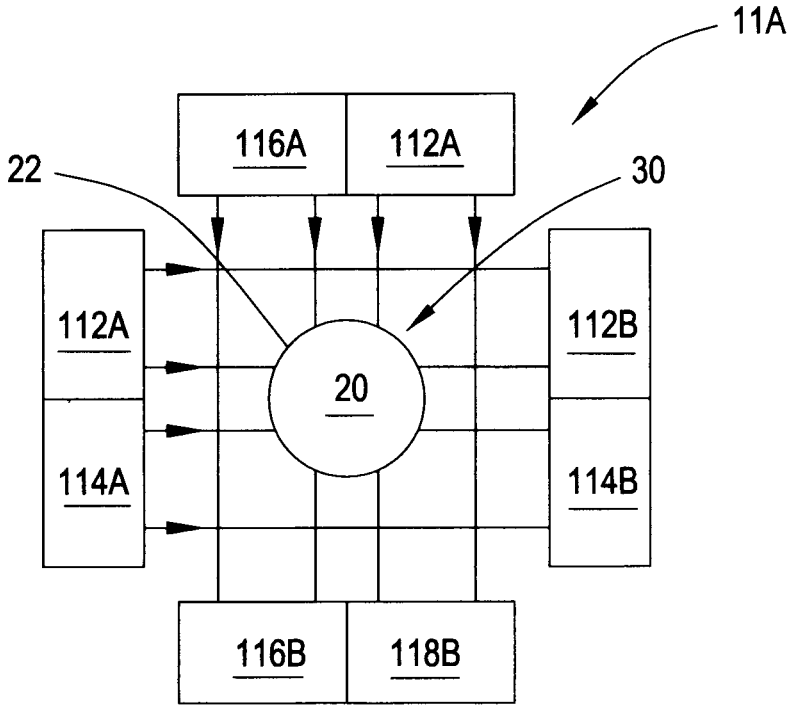
Figure 13:
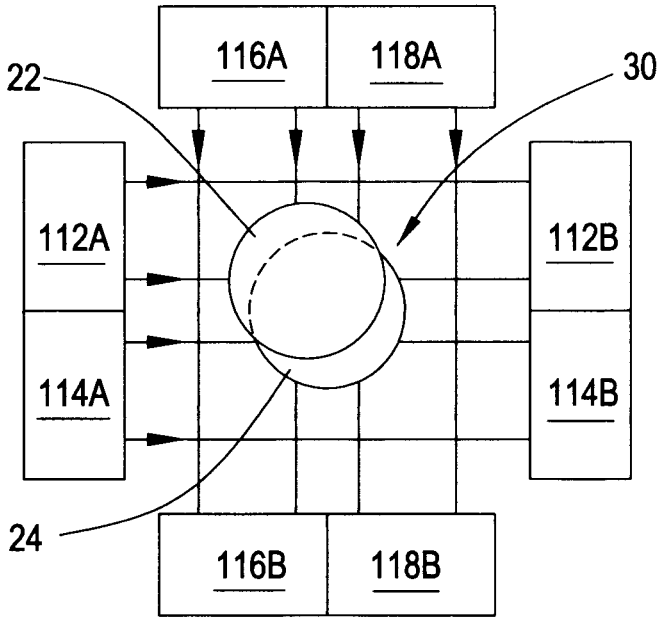
Figure 14:
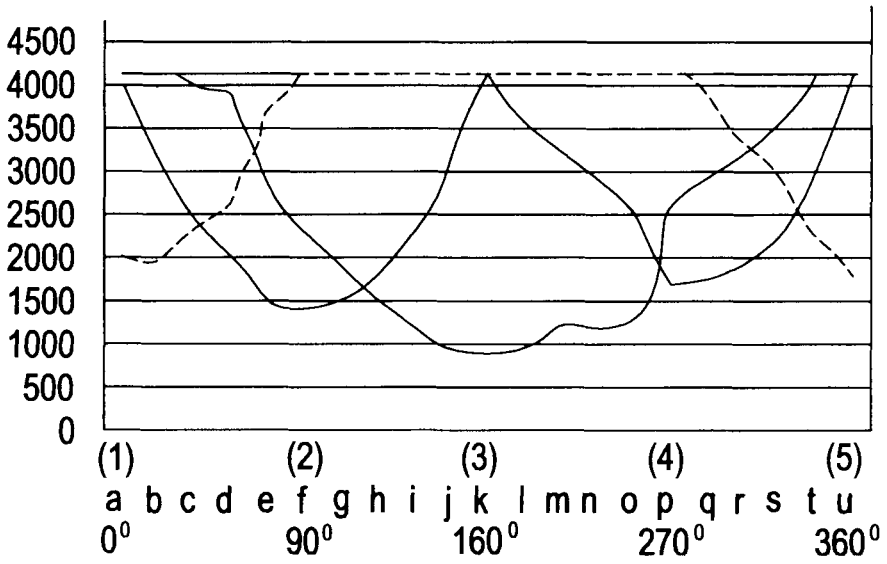
Figure 15:
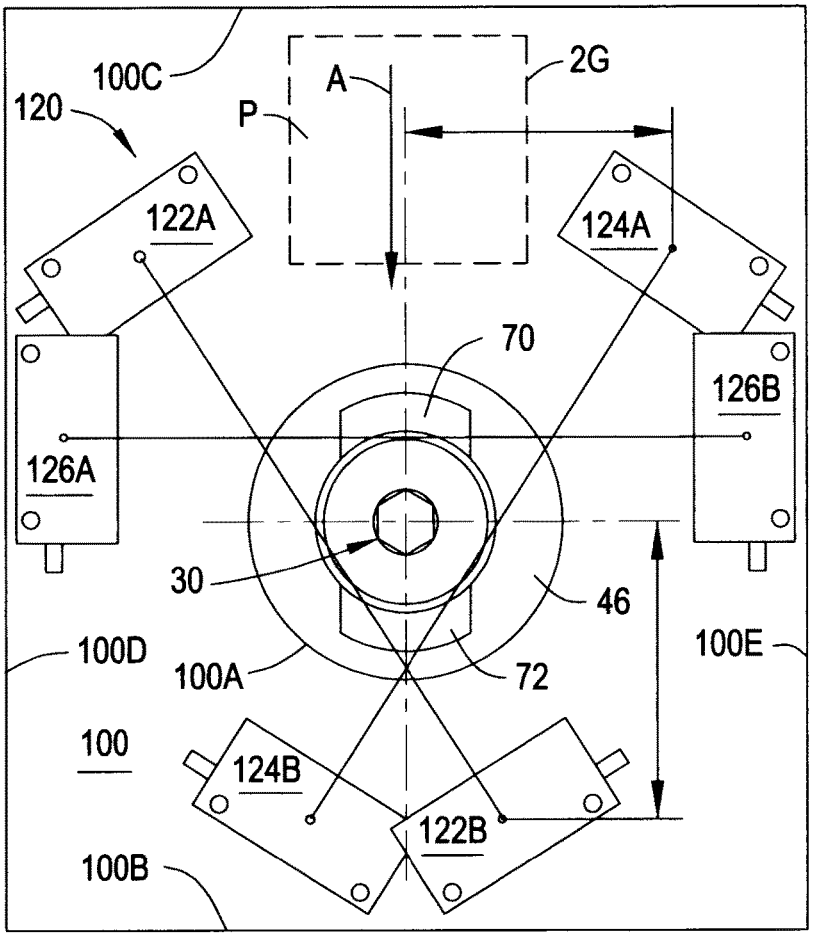
Figure 16:
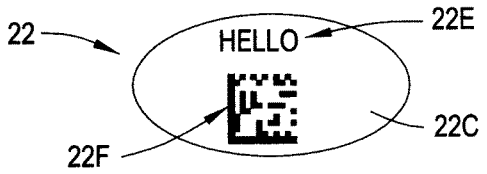
Figure 17:
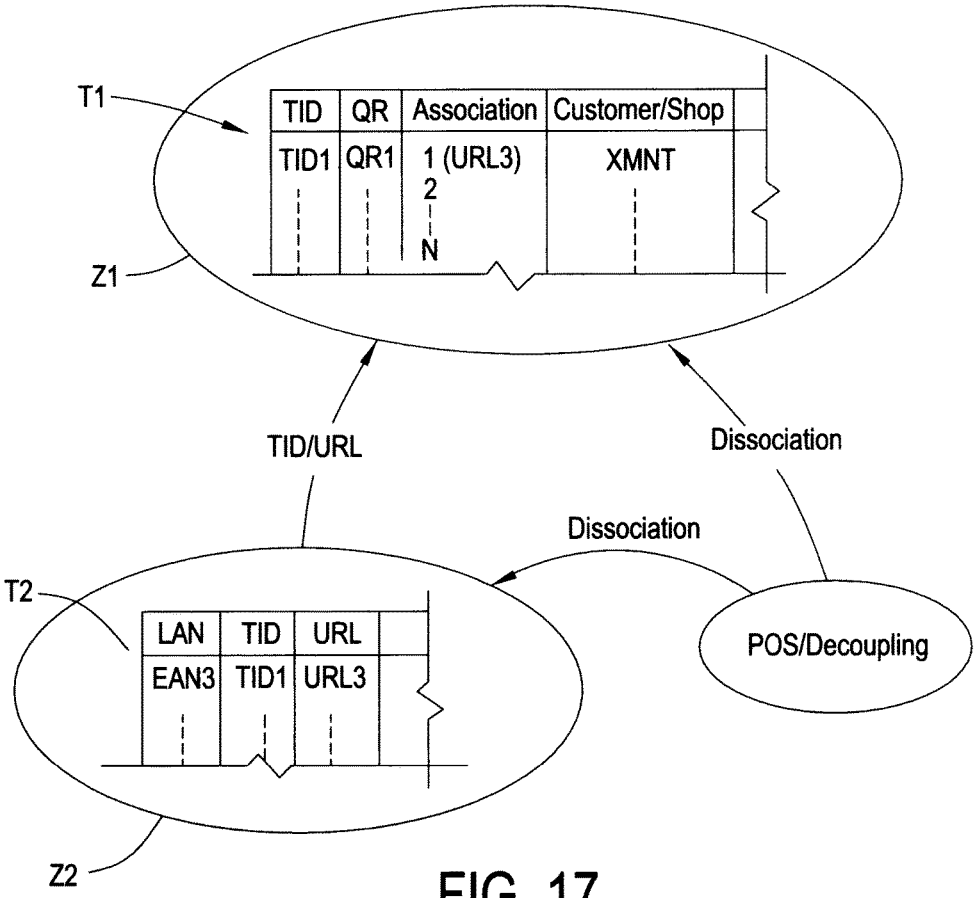
Figure 18:
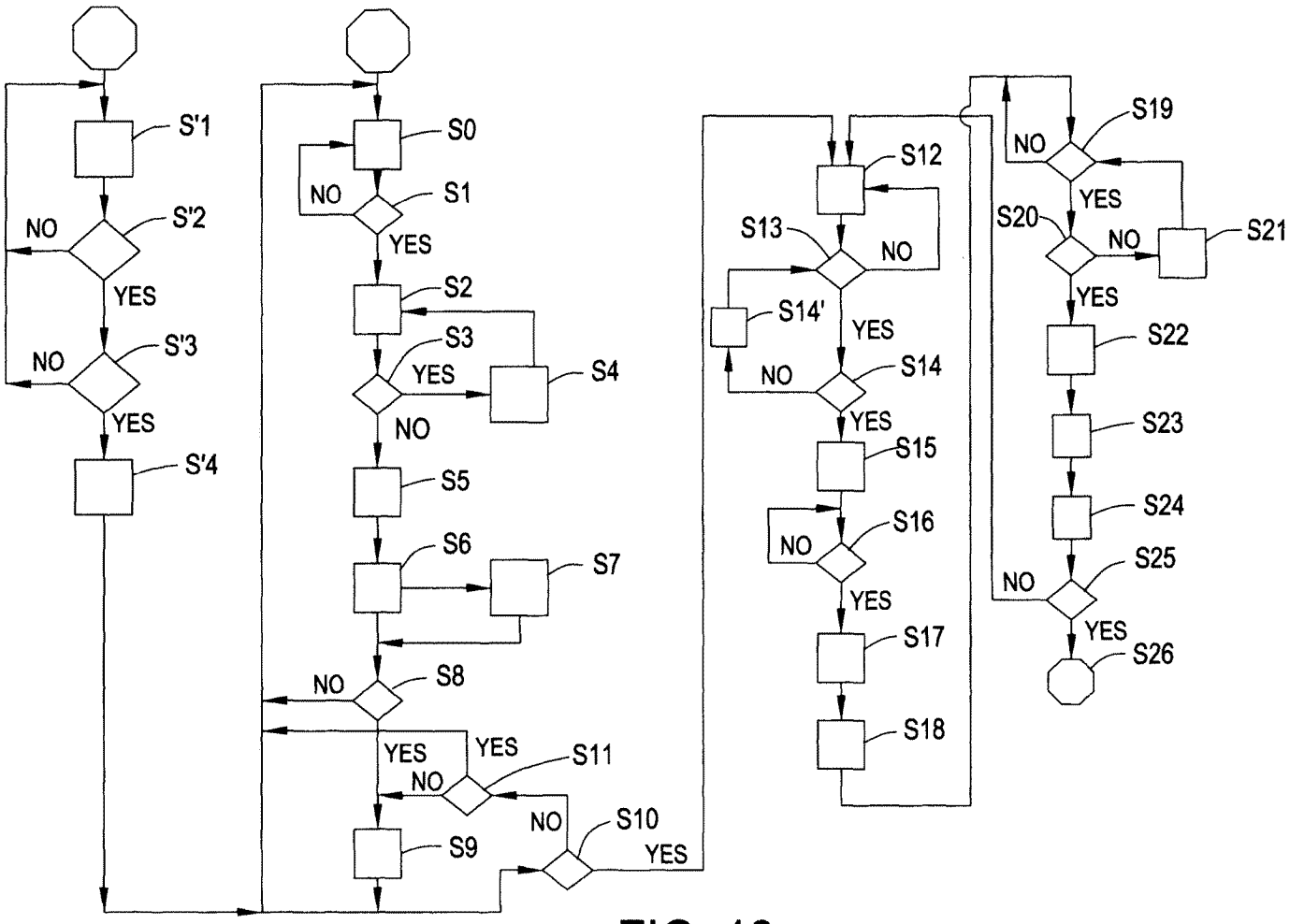
Figure 19:
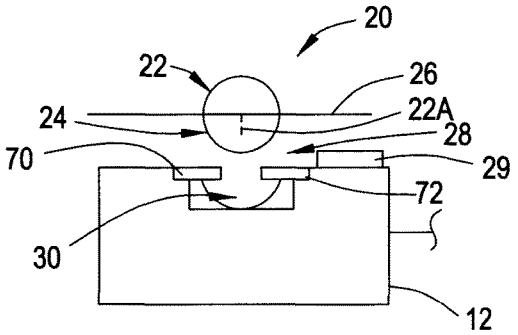
Figure 21:
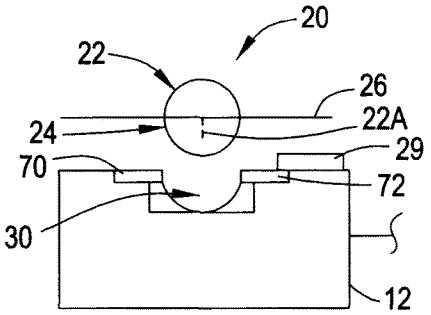
Figure 22:
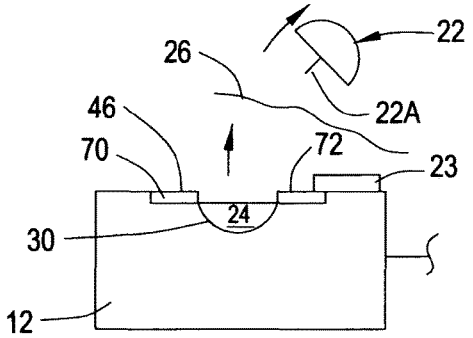
Figure 23:
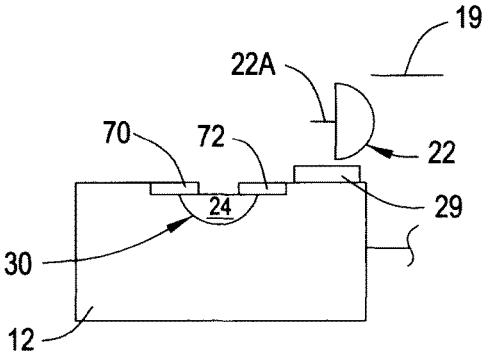
Figure 24:
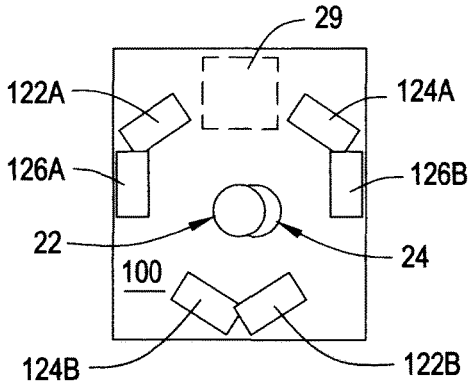
Figure 25:
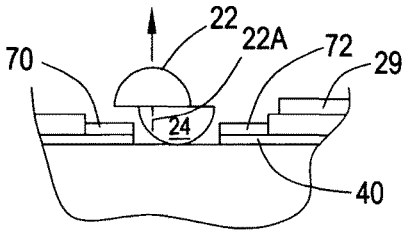
Figure 20:
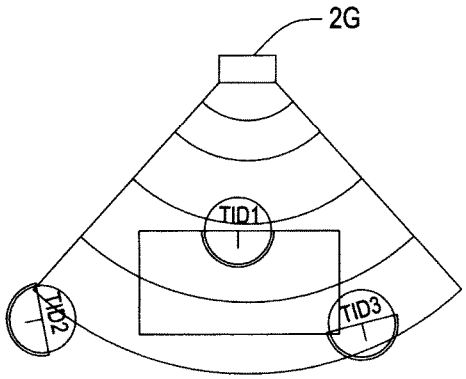
Figure 26:
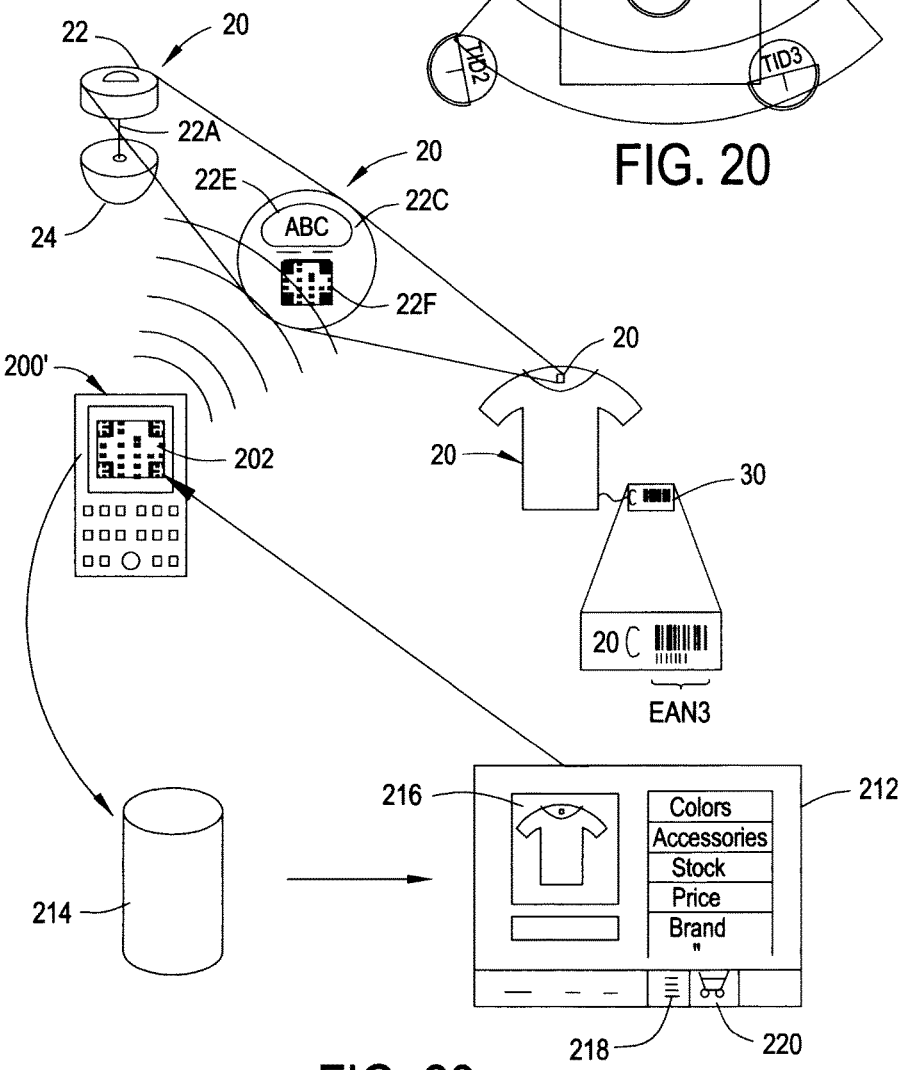
Figure 27:
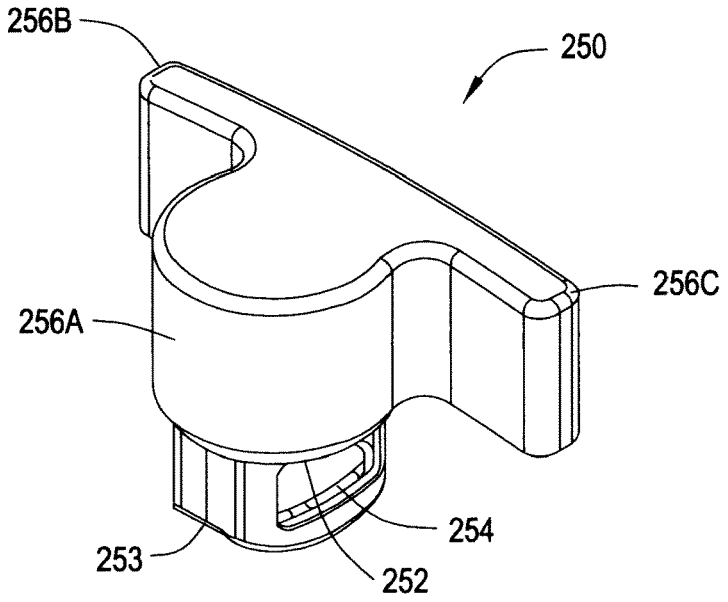
Figure 28:
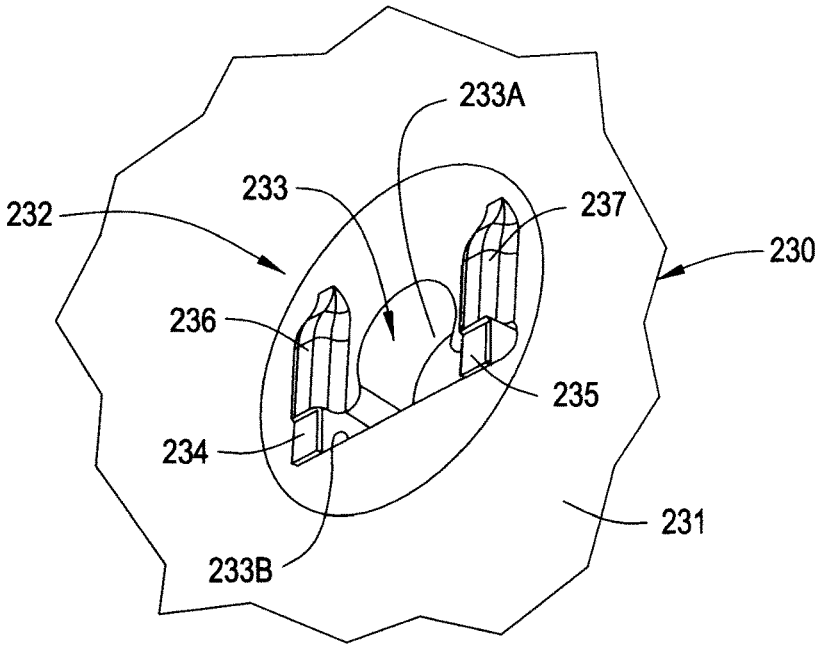
Figure 29:
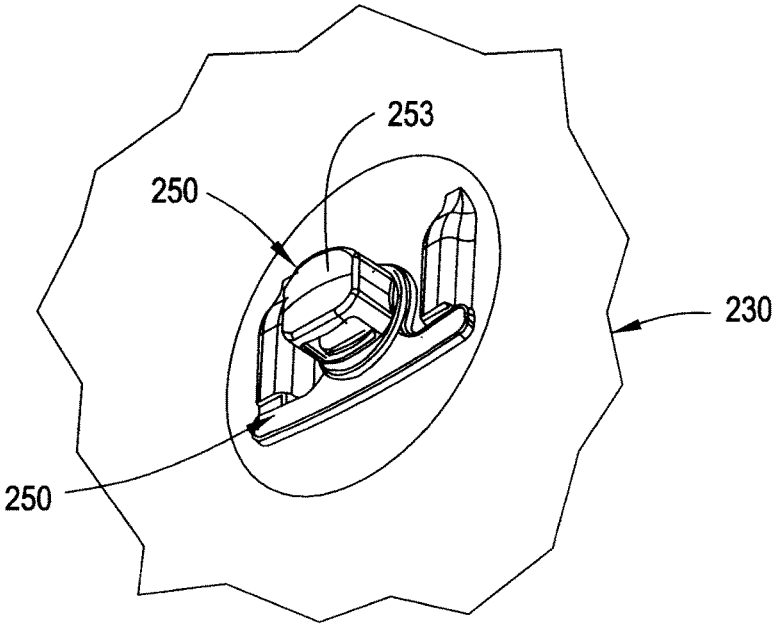
Figure 30:
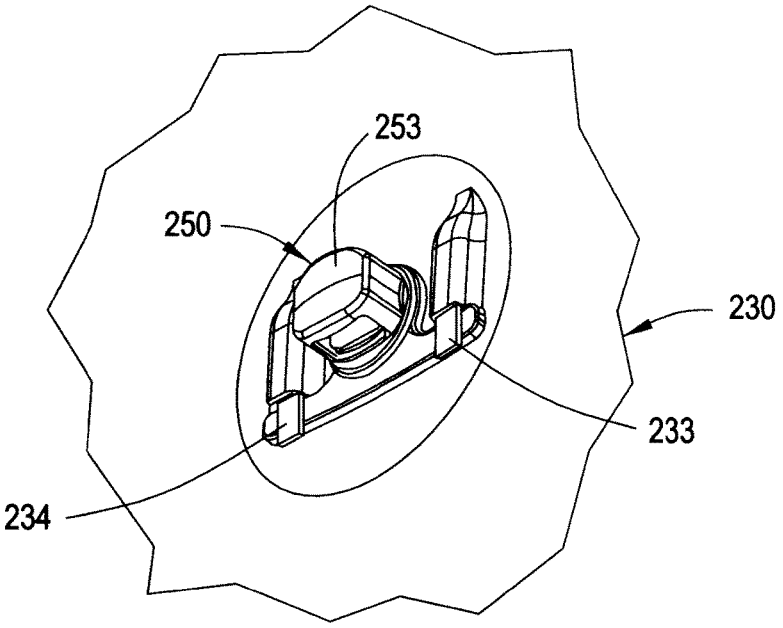

FIGS. 10A-B illustrate a first embodiment of means making it possible to couple in a temporary manner two separable elements of an identification device according to the invention;

FIG. 10C is a variant embodiment of the means for holding the tip;

FIG. 11 illustrates a second embodiment of means making it possible to couple in a temporary manner two separable elements of an identification device according to the invention;

FIGS. 12 and 13 illustrate, viewed from above, the arrangement of electromagnetic detection means and, respectively, the positioning of the first element 22 on the second element 24 in the axial locking configuration (FIG. 12) and in one of the possible shifted configurations (FIG. 13);

FIG. 14 illustrates four curves of signals received by each of the means for receiving of each of the four pairs of emitting and receiving elements of FIGS. 12 and 13;

FIG. 15 is a view from above of another arrangement means of electromagnetic detection around the unlocking zone of a decoupler;

FIG. 16 is an end-on view of the head 22 of the identification device 20 carrying an optical code;

FIG. 17 is a general schematic view illustrating the various code associations recorded in computing system memory areas;

FIG. 18 is an algorithm of a method for managing the unlocking of an identification device according to an embodiment of the invention;

FIG. 19 illustrates the activated blocking means of the decoupler so as to prevent access of the unlocking zone to the identification device 20 of FIGS. 1B and 1C;

FIG. 20 illustrates the placement in situation of the detection of several identification devices in proximity to the decoupler receiving zone;

FIG. 21 illustrates the blocking means of FIG. 19 deactivated;

FIG. 22 illustrates the receiving of the second element of the identification device of FIGS. 1B and 1C in the unlocking zone of the decoupler after unlocking and freeing of the article;

FIG. 23 illustrates the second element of the device of FIG. 22 in the blocked position and the return of the first element;

FIG. 24 represents, viewed from above, the positioning of the first element 22 on the second element 24 in one of the possible shifted configurations with the arrangement of the electromagnetic detection means of FIG. 15;

FIG. 25 is a magnified partial view of the two elements of FIG. 24 in the shifted position with the mobile peripheral part 40 of the decoupler in the bottom deblocking position;

FIG. 26 is a general schematic view of the placement in situation of an embodiment of the invention;

FIG. 27 illustrates in a schematic manner an antitheft device according to another embodiment of the invention;

FIGS. 28 to 30 illustrate various views of a decoupler according to another embodiment and its cooperation with the device of FIG. 27.

As represented in FIG. 1A and designated by the general reference denoted 10, a system for managing the unlocking of identification devices according to the invention (these devices are generally fixed to commercial articles or to packaging containing these articles) comprises:

an unlocking device 12 or decoupler, for example magnetic, for the unlocking of an identification device;

a point of sale (POS) of a shop which comprises a checkout till or payment terminal 14 equipped with a screen.

The decoupler 12 is linked to the POS so as to be able to communicate information/data with one another. The POS is linked to a computing system which comprises in particular a database 16 in which are stored the references of the articles on sale in the shop (EAN codes, etc.), other data which will be defined later, the stock of articles in one or more shops, the transactions performed, etc.

The decoupler 12 also comprises a system 18 for processing data, for providing electrical energy, and for communicating information/data, in particular with the payment terminal 14. This system ensures in particular the management of the decoupler and in particular the actuation/the activation or the deactivation of the various constituent mobile parts of the decoupler (blocking members, etc.) and of the various functional elements (optical sensors, etc.), the management of the various, in particular electrical, signals, etc. (their production, their transmission, their reception, their storage, their processing, etc.). The system 18 (shown diagrammatically dashed in FIG. 1A) comprises in particular a set of connection elements for interface with the exterior of the decoupler and a set of elements for internal connection with the various components internal to the decoupler. The system moreover comprises permanent means for storing provisional data (memory of buffer type).

The aforementioned system 10 applies to an identification device of a commercial article which may or may not be packaged. This identification device is for example an antitheft device 20, also called an antitheft tag, which comprises, in this exemplary embodiment, two mutually separable elements 22, 24. These two elements are displaceable or mobile with respect to one another between two positions, a locked position (FIG. 1B), in which the two elements fixed to one another imprison the commercial article 26 or its packaging between them, in a locked manner under the action of locking means, and at least one unlocked position (FIG. 1C). In this example, the two elements can be dissociated physically from one another as illustrated in FIG. 1C. As will be seen subsequently, the two elements 22, 24 can be fixed to one another in one or more other unlocked positions.

As represented schematically in FIGS. 1B and 1C, the device 20 comprises a head 22 (first element) furnished with a tip 22*a* which extends away from the head and which is intended to pass through the physical object 26 (commercial article). The device 20 also comprises a body 24 (second element) provided with an orifice for inserting the tip 22*a* axially inside the body in a so-called locked position. The body also comprises, in a known manner, means for locking the inserted tip so as to prevent its axial withdrawal. Such means are for example balls-based means which will be described subsequently.

Figure 1D:
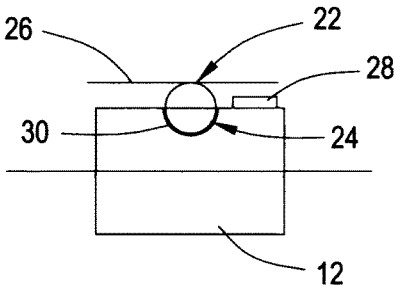
FIG. 1D illustrates the reception of the identification device of FIGS. 1B and 1C in the unlocking zone of the decoupler of FIG. 1A.

The decoupler 12 comprises an unlocking zone which, here, comprises a receiving zone 28 intended to receive the device 20 which is fixed in a locked manner to the article 26 (FIG. 1D). A device 29 for reading identification information (identifier) of the device 20 and its association with the article 26 is disposed alongside the receiving zone accommodating said device 20, for example on the upper surface of the decoupler 12.

This receiving zone 28 comprises more particularly a part forming a housing 30 which is able to receive one of the two elements 22, 24, namely here the body 24 (second element). This housing has a general shape and dimensions which are substantially complementary to those of the element 24 that it receives. For example, the housing 30 is cup shaped and has a shape inverse to the general domed shape of the body 24. This housing ensures a function of mechanical stabilization of the identification device 20 insofar as said housing stabilizes the body 24 in a predetermined geometric orientation on the decoupler unlocking surface.

FIGS. 2 to 7 represent the decoupler 12 of FIGS. 1A and 1D according to an embodiment of the invention.

Figure 2:
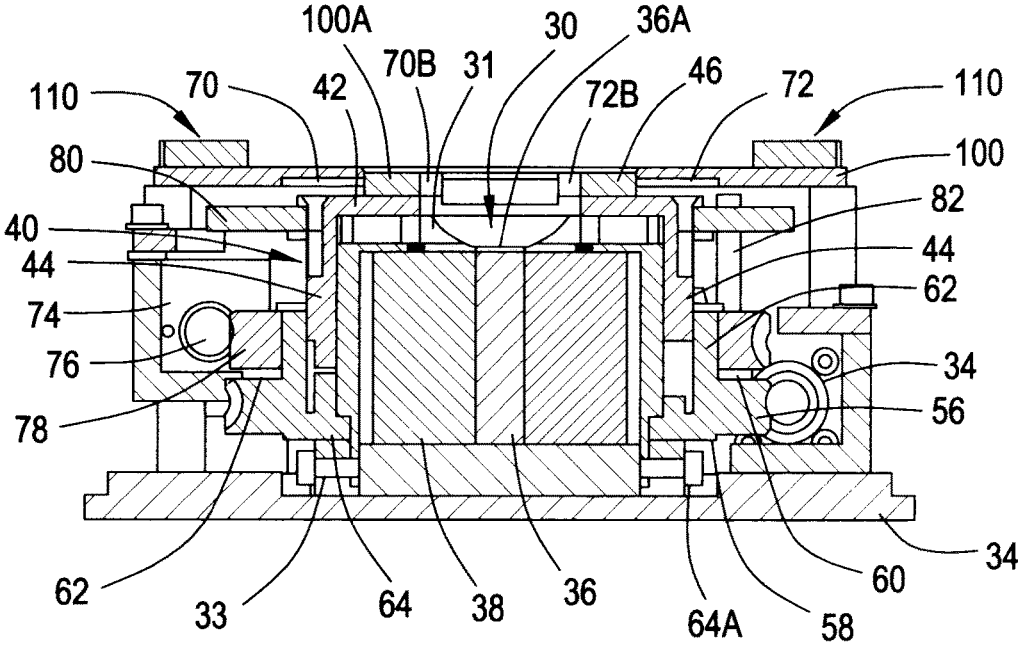
FIGS. 2 to 7 represent various components of a decoupler 12 according to an embodiment of the invention.
Figure 3:
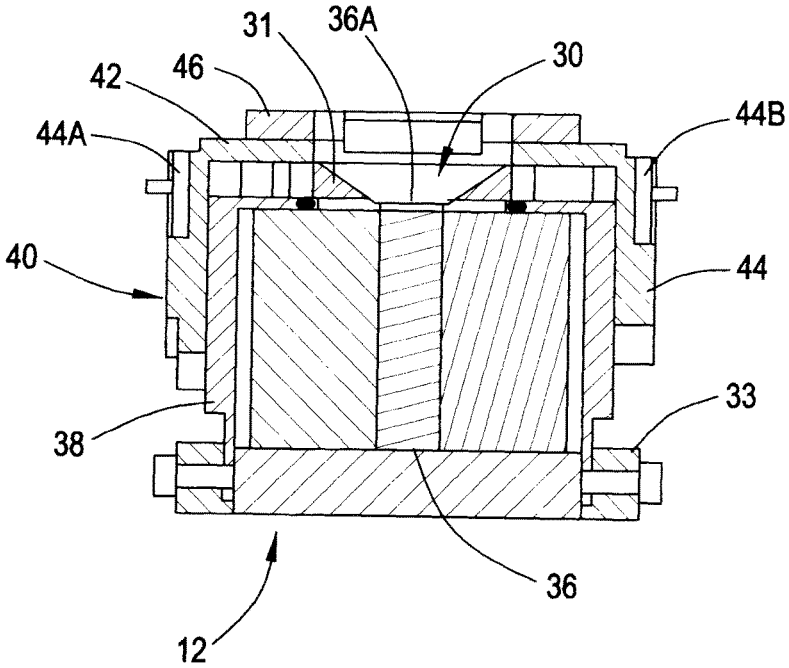

As represented in axial section in FIG. 2, the decoupler is mounted on a footing 34. In FIG. 3, the decoupler is represented without its footing and without the peripheral components of the decoupler that will be described subsequently.

The decoupler 12 comprises at least one permanent magnet 36 enclosed in a casing 38. The decoupler comprises an upper unlocking surface 36*a* which corresponds to the upper surface of the magnet and on which the bottom of the part forming a housing 30 is open. The part forming a housing comprises a mechanical stabilizer 31 which is a body having external walls continuously surrounding a cup shaped central housing (it will be noted that other shapes of body may be suitable, for example with interrupted walls). The unlocking surface 36*a* is perpendicular to the axial (vertical) direction of the magnetic field. The mechanical stabilizer 31 orients along this axial direction the identification device which is received therein. The predetermined geometric orientation thus conferred on the identification device allows the magnetic field generated by said at least one permanent magnet 36 to magnetically unlock the two elements 22, 24 of the device that are locked together and, thus, to free the article imprisoned between them.

Said at least one permanent magnet 36 and the casing 38 are mounted in a fixed manner in the decoupler.

The decoupler 12 also comprises a vertically mobile peripheral part 40 surrounding the part forming a housing 30 and the casing 38 and which is able to slide around these components so as to occupy two positions:

a top blocking position (illustrated by solid lines in FIGS. 2 and 3), in which the peripheral part 40 is situated at a height above or equal to the height of the second element 24 (represented in FIG. 1D) disposed in the part forming a housing 30 and a bottom deblocking position (partially illustrated dashed in FIG. 3) in which the peripheral part 40 positions itself by sliding from the top position. In this bottom position, the peripheral part 40 is situated at a height below the height of the second element 24 which is disposed in said part forming a housing 30 so as to facilitate its withdrawal/extraction from the housing.

The peripheral part 40 comprises a horizontal annular upper platen 42 disposed around the stabilizer 31 and, at the periphery of said platen, a vertical skirt 44 which extends around the casing 38 toward the footing 34 (FIG. 2). The upper platen 42 is surmounted by a ring 46 completely bordering the opening for access to the housing 30. The skirt extends in a manner interrupted locally around the casing 38 so as to create axial (vertical) slots 44*a*, 44*b* . . . (for example three) in each of which is disposed an elastic means 48*a*, etc. This elastic means is mounted in a fixed manner, on the one hand, in the bottom part, on a support element 50 linked to the casing 38 and on the other hand, in the top part, on the peripheral part 40 through the openings 52 made at the periphery of the platen 42. The elastic means are for example axial restoring springs which tend to urge the peripheral part 40 downwards.

The decoupler comprises a mechanism for displacing the peripheral part 40, which is activated or not as a function of the realization or of the absence of realization of a predetermined condition which will be detailed subsequently.

This displacement mechanism comprises a first motor 54 furnished, on its output shaft, with a threading 56 disposed in a manner adjacent to the mobile peripheral part 40.

Figure 4:
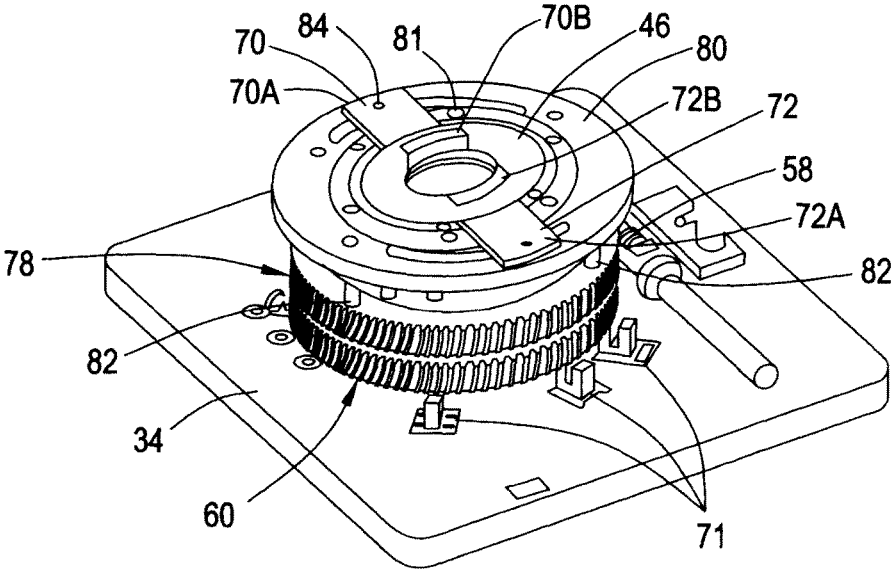

The mechanism also comprises a lower component 58 which extends axially around the casing 38 and the skirt 44 (FIG. 2). The lower component 58 (not represented in FIG. 3) is mounted on a plinth 33 which is provided for at the base of the decoupler (FIGS. 2 and 3) and which projects beyond the casing 38. The lower component 58 comprises at its exterior periphery a horizontally disposed toothed wheel or crown 60 which cooperates by enmeshing with the threading 56 of the output shaft of the motor (FIG. 4). The rotation of the output shaft makes it possible to turn the toothed crown 60 about its vertical axis.

The lower component 58 comprises a cylindrical wall 62 which extends axially upwards starting from the toothed crown 60 up to the elevation of the lower part of the skirt 44 (FIG. 2).

Figure 5:
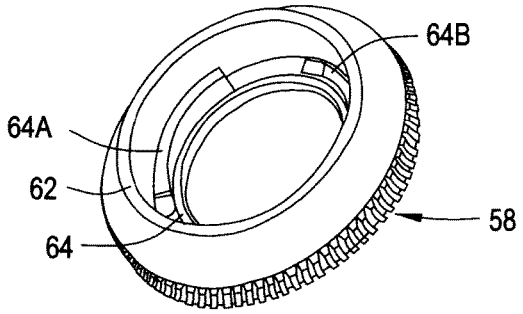

As represented in FIG. 5, the lower component 58 comprises an internal collar 64 arranged substantially in the same plane as the toothed crown 60 and which extends radially toward the interior of the component and away from said crown. The collar comprises on its upper rim several cam means (for example three) which take for example the form of ramps 64*a*, 64*b* . . . arranged along the circumference of the collar.

Figure 6:
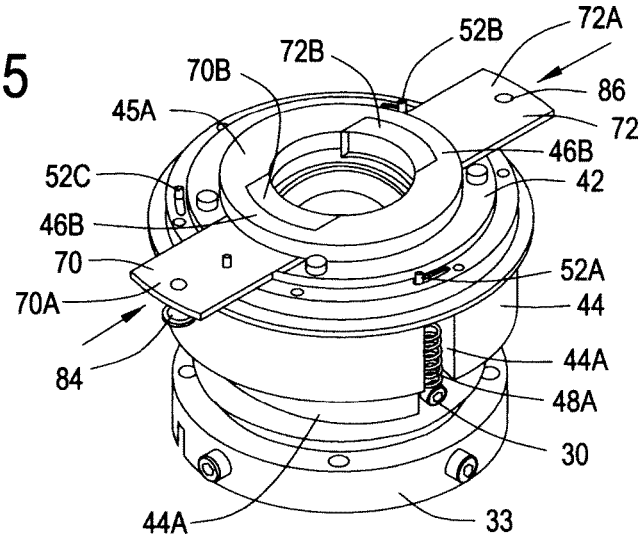
Figure 7:
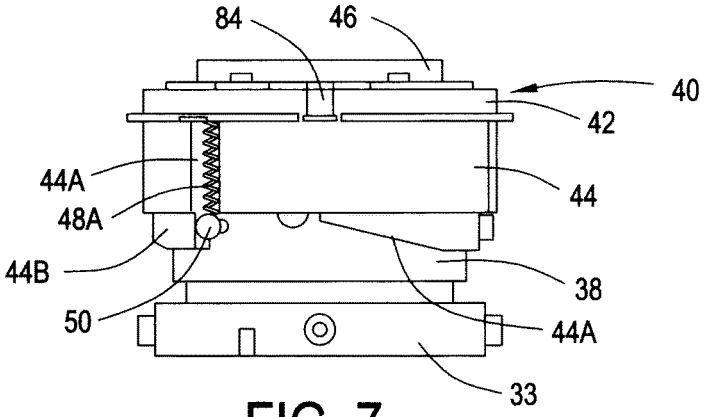

The skirt 44 of the peripheral part 40 comprises at its lower part several cam means (in correspondence with the number of cam means of the lower component 58) which also take the form of ramps 44*a*, 44*b* . . . (FIGS. 6 and 7). These ramps have shapes complementary to those of the ramps 64*a*, 64*b* . . . so as to be able to cooperate with the latter while the toothed crown 60 is being driven in rotation and to allow the peripheral part to ascend or descend according to the motion selected. During the ascending or descending motion, the skirt 44 slides inside the annular space created between the casing 38 and the cylindrical wall 62. In a variant, not represented, the shape of the cam means and, in particular, the cam profile can vary.

The decoupler 12 moreover comprises mechanical blocking means which prevent physical access of an identification device, such as the device 20 of FIGS. 1B to 1D, to the part forming a housing 30 of the decoupler.

These mechanical means for preventing access comprise one or more mobile blocking members 70, 72 which are able to occupy, on the one hand, a deployed position preventing physical access of the identification device to the part forming a housing 30 of the decoupler (blocking of the opening for access to the housing) and, on the other hand, a retracted position permitting physical access of the identification device to the part forming a housing of the decoupler (clearance of the opening for access to the housing).

These mobile blocking members take for example the form of two hatches 70, 72 which are mounted in a diametrically opposite manner in the ring 46. More particularly, the hatches have a plane general shape which extends radially with respect to the ring and away from the latter up to a respective free end 70*a*, 72*a*. The hatches exhibit an opposite end 70*b*, 72*b* fitted out in the ring and whose height is greater than that of the plane part of the hatches. These thickened opposite ends 70*b*, 72*b* (heads) are inserted into recesses made on the interior edge 46*a* of the ring 46 so as to reconstruct the complete shape (gapless) of the ring. The hatches are slidably mobile in the directions indicated by the arrows in FIGS. 4 and 6. In these figures the hatches are in the open or retracted position and are thus retained in their motion by the exterior edge 46*b* of the ring. The hatches can, on activation (command), deploy toward the interior of the ring 46 and thus partially close the opening making it possible to access the housing 30. Partial closure reducing the diameter of the opening to a diameter smaller than the dimensions of the element 24 suffices to prevent access.

The decoupler comprises a mechanism for displacing the mobile members 70, 72 which is activated or not as a function of the realization or of the non-realization of a predetermined condition which will be detailed subsequently.

This displacement mechanism comprises a second motor 74 furnished, on its output shaft, with a threading 76.

The mechanism also comprises a so-called upper toothed wheel or crown 78 disposed horizontally around the cylindrical wall 62, above the so-called lower toothed crown 60 and which cooperates by enmeshing with the threading 76 of the output shaft of the motor 74. The rotation of the output shaft makes it possible to turn the toothed crown 78 about its vertical axis. The second motor 74 is disposed at a greater elevation than that of the first motor and on another side of the decoupler for bulkiness reasons.

The displacement mechanism furthermore comprises:

- an annular disk 80 (control disk) mounted at the periphery of the platen 42 and of the skirt 44, in the prolongation of said platen 42;
- a set of vertical rods 82 which fasten the annular disk 80 to the upper toothed crown 78;
- two guidance apertures 81, 83 (FIG. 4) passing through the disk in its thickness and which are disposed in a diametrically opposite manner, each aperture extending according to one and the same angular sector; each aperture 81, 83 possesses a first end (e.g.: 83*a*) close to the interior edge of the disk and extends, according to an angular sector, across the disk, toward the exterior edge of the latter in such a way that the opposite second end (e.g.: 83*b*) of the aperture is further away from the interior edge than the first end;
- two cam fingers 84, 86 (FIGS. 4 and 6) which are fixed respectively to the free ends 70*a*, 72*a* of the hatches 70, 72 so as to extend toward the footing, the fingers being introduced respectively inside the guidance apertures 81, 83 (FIG. 4).

The profile of the guidance apertures 81, 83 is a cam profile which makes it possible to cooperate respectively with the cam fingers 84, 86. The rotation of the upper toothed crown 78 drives the rotation of the disk 80 and of its apertures 81, 83 which force the respective cam fingers to follow the cam profile of the apertures and therefore to recede from (closing of the hatches 70, 72) or to approach (opening of the hatches) the exterior edge of the disk.

The two toothed crowns are independent of one another in their motion insofar as the displacement of the peripheral part 40 is independent of the displacement (opening and closing) of the blocking members 70, 72.

The whole assembly of the mechanisms for displacing the mobile peripheral part 40 and the mobile blocking members 70, 72 forms a relatively compact rotary single block. The set of various motions is obtained on the basis of the rotation of the two crowns, thereby facilitating the management of the mechanisms. This assembly is particularly robust and easily industrializable.

The decoupler 12 comprises for example optical sensors (or of some other type) 71 which are disposed on the footing according to the circumference of the lower crown 60 so as to determine the latter's angular displacement during its rotation motions. This makes it possible to determine the rotation of the motor.

The part forming a housing 30 and, more particularly, the stabilizer 31 does not participate in the ascending and descending motion of the peripheral part 40.

Figure 8:
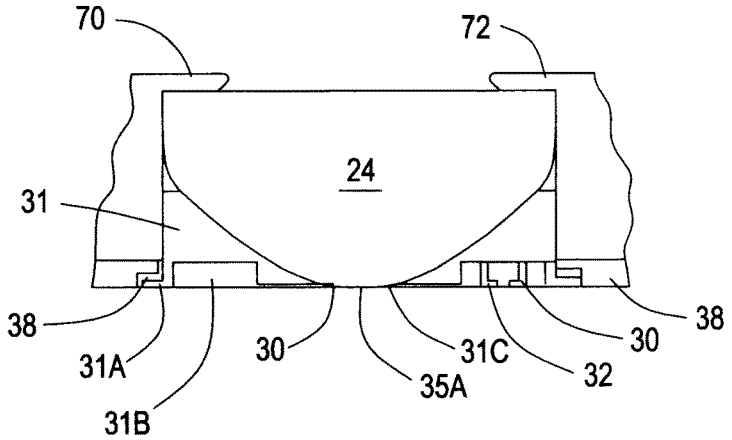
FIG. 8 is a partial magnified view of the element 24 of the identification device 20 of FIGS. 1B and 1C in the position blocked in the housing of the decoupler.

The stabilizer 31, represented in a magnified manner in FIG. 8, is mounted on the unlocking surface 36*a* by way of an external collar 31*a* which is engaged in a peripheral groove 38*a* made in the upper part of the casing 38 which covers the magnet or magnets. This stabilizer exhibits on its lower surface an annular cavity 31*b* hollowed out in the thickness of the body and which surrounds the hole 31*c* drilled in the bottom of the stabilizer. Several contact sensors or contactors (e.g.: three distributed at 120°) such as the sensor 90 are mounted on the body inside this cavity 31*b*. Elastic means such as compression springs, for example the spring 92, are mounted in the cavity 31*b*, for example around the respective sensors, so as to naturally thrust the body of the stabilizer upwards. In the absence of a second element 24 of an antitheft device 20 placed in the housing of the stabilizer, the springs 92 thrust said stabilizer upwards and the latter is held in the top position by its collar which is against the upper rim of the groove 38*a*.

When a second element 24 of an antitheft device 20 is placed in the housing of the stabilizer (in FIG. 8 only the second element 24 is represented and it is therefore assumed that unlocking has taken place and the first element 22 has been withdrawn), this element is close to the unlocking surface and the magnet or magnets of the decoupler attract said element against the surface. The stabilizer is thus displaced downwards against the compression load of the springs until the contact sensors 90 come into contact with the upper surface of the decoupler. Thus, the stabilizer is able to move vertically over a limited travel defined by the height of the peripheral groove. One or more electrical links (not represented) are envisaged between the contact sensors and the data processing system 18 of the decoupler so as to transmit to the latter the information that the antitheft device is in the unlocking position. The processing system 18 is not represented in FIGS. 2 to 8 for the sake of simplification.

It will be noted that in FIG. 8 the blocking members 70, 72 are activated in the blocking position (hatches closed) so as to block the second element 24 in the housing.

The decoupler comprises a hood 100 which covers the various components described hereinabove and only the upper part of which is represented in FIG. 2. A circular cutout 100*a* has been made in this part so as to leave free an annular space above the ring 46 for its vertical motion around the opening for access to the housing.

Figure 9:
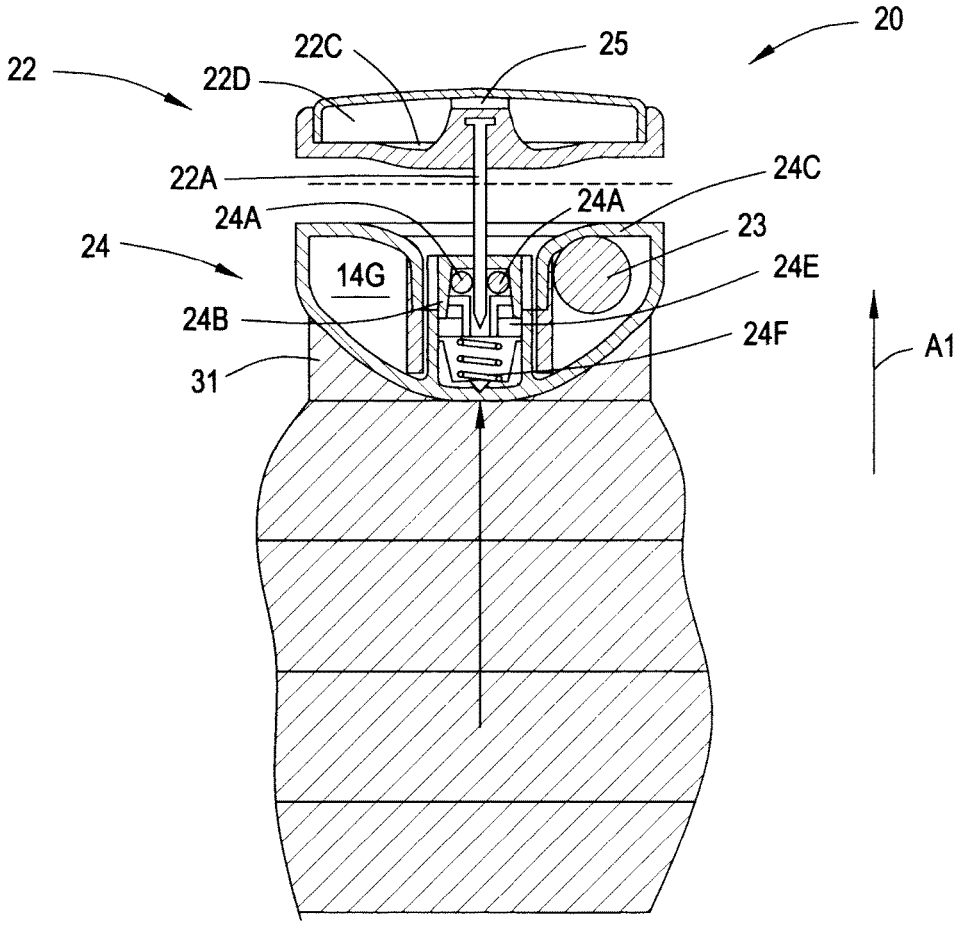
FIG. 9 is a magnified partial schematic view of the identification device 20 stabilized in the unlocking zone of the decoupler 12.

FIG. 9 is a magnified partial schematic view of an antitheft device 20 stabilized in the decoupler 12 receiving zone.

The means for locking the device 20 will now be described with reference to this figure.

The body 24 of the device 20 encloses a central cavity in which are disposed the aforementioned balls-based locking means or other locking means. Several balls 24*a* are placed in a component forming a funnel 24*b* inside the cavity, in one and the same plane and create between them a central space to receive the tip 22*a*. The body also comprises a plate or platen 24*c*, for example substantially plane, which closes the access to the internal portion of the body. A central orifice 24*d* for inserting the tip is made in the plate 24*c*. When the tip is inserted into this orifice and into the inter-ball central space, the balls wedge in the convergent part of the funnel. Any attempt to axially withdraw the tip tends to sink the balls further into the convergent part of the funnel and therefore to lock the tip (locked position of the two elements of the device imprisoning a commercial article between them). The balls are mounted on a support 24*e* made of amagnetic material, which is mounted on elastic means made of amagnetic material, such as a spring 24*f*. The elastic means exert on the support 24*e* and therefore on the balls an axial load (along A1) which tends to thrust them further into the narrowest part of the funnel 24*b*. It will be noted that the balls are made of a magnetic material, thereby making it possible to extract them from the convergent part of the funnel under the action of the external magnetic field generated by the magnet 36 when the axis of alignment of the funnel, of the balls and of the elastic means merges with the axis of the magnetic field.

In FIG. 9 the device has been unlocked and the first element 22 is being withdrawn. For the sake of clarity, the commercial article imprisoned between the two elements of the antitheft device is not represented.

Moreover, the body 24 also comprises at the periphery of the central cavity an annular chamber 24*g* in which is arranged a member 23, or indeed several members, for example passive, that is to say it is able to receive electromagnetic waves originating from a source outside the device. Such a member may for example take the form of a resonant circuit of LC type.

Alternatively, the body may enclose one or more active members, that is to say which are able to emit electromagnetic waves toward the exterior of the device and to receive some. Active or passive members such as these are for example coils with ferrite, with or without capacitor, LCR circuits, magnetic filaments, circuits of RFID type fitted with an active or passive memory chip, electronic microsensors, etc. This or these members cooperate, via the transmission of electromagnetic waves, with a detection system, such as a gantry or an antenna, placed at an access point of the shop where the article to be protected is on sale, so as to trigger an alarm in case of detection of the device at the level of the access point. By way of variant, this or these members are disposed in the head 22 of the device. The presence of this or these members affords the identification device an additional antitheft function. However, this function is only optional for the implementation of the invention.

The description which follows, given with reference to FIGS. 10A-C and 11, sets forth the way in which the two separable elements of an antitheft device 20 may be fixed to one another in the unlocked positions.

FIGS. 10A-B illustrate one of the functionalities of the identification device 20 which makes it possible to assemble/fix the two separable elements 22, 24 together in a temporary manner according to a configuration which is shifted transversely or laterally with respect to the axial configuration of FIG. 9. This axial configuration is delineated in FIG. 10A by the longitudinal axis L (here vertical). In this axial configuration (L) the two elements 22, 24 are aligned one with the other by axial insertion of the tip 22*a* into the central orifice 24*d* and are locked to one another (locked position). In the shifted configuration (delineated in FIG. 10A by the shifted longitudinal insertion axis L1) the two elements are fixed to one another in an unlocked position, thereby making it possible to separate them manually at leisure by a simple maneuver, without calling upon a tool such as the decoupler 12. However, in this unlocked shifted position, the tip 22*a* is held sufficiently firmly in the body of the element 24 so that the head 22 (first element) does not fall in the arrangement of FIG. 10A, and so that the body 24 does not fall in the inverse arrangement.

FIG. 10B represents a frontal view of the plate 24*c* of the body 24 which carries the central orifice 24*d* in a first central area Z1 and which is provided with a second zone Z2 (e.g.: peripheral) distinct from Z1 and in which a plurality of regularly distributed openings O1, O2, O3, O4, O5 are made. Each opening O1-O5 is surrounded by an appropriate guidance zone which takes for example the form of a concavity or of a flaring (any convergent shape such as a cup or funnel shape) fitted out around the opening so as to guide the tip 22*a* up to and into the latter. This arrangement facilitates the operation of inserting the tip in one of these unlocked positions. It will be noted that for each of these positions (transversely shifted configuration of the two elements 22 and 24) the tip is inserted axially along the insertion axis L1 (FIG. 10A) which is parallel to the insertion axis L or another axis which is parallel to the insertion axis L and to the axis L1.

As represented in FIG. 10A, the tip 22*a* is held inside the body 24 by a holding member such as a ring 24*h* keyed around the central part 24*i* of the body which houses the central cavity accommodating the balls-based locking means. It will be noted that the tip is introduced under force between the central part and the ring whose dimensions are adjusted to prevent overly easy axial withdrawal (for example by inverting the assembly as illustrated in FIG. 10A). Alternatively, it could be envisaged merely to adjust the cross-sectional dimensions of each opening O1-O5 so as to hold the tip tightly clamped by the wall alone surrounding the opening.

According to an antitheft device variant 20' illustrated in FIG. 10C, another holding member fastened to the body of the second element 24' takes the form of an elastic tab 24*h'* tied to the plate 24*c* and which is able to deviate slightly upon passing from the tip 22*a'* of the first element 22' and to hold the tip against the central part 24*i'* of the body so as to prevent untimely axial withdrawal. The tab is for example furnished with a thickening at its free end which comes into contact with the tip 22*a'*.

FIG. 11 illustrates another embodiment of an antitheft device 170 which makes it possible to assemble/fix the two separable elements 172, 174 of the device together in a temporary manner according to a configuration which is shifted transversely or laterally with respect to the axial locking configuration. In the axial locking configuration, the tip 172*a* of the head 172 is inserted into the central orifice 174*a* situated in a first zone of the body 174. A second distinct zone comprises a flexible and elastic material 176 into which the tip 172*a* can be inserted at leisure in a multitude of possible unlocked axial positions so as to be held there in a temporary assembling/fixing position.

Such a material which is elastically deformable can thus accommodate the tip after insertion of the latter into the body of the material and this tip can be withdrawn entirely at leisure when the temporary assembling is terminated.

Such a material is for example an elastomer such as a rubber which can be injection molded in order to adopt the chosen shape so as to be able to be housed inside the casing of the body 174 in a space of predefined dimensions and shapes.

In the example illustrated in FIG. 11, the second zone comprising the material completely surrounds the first zone containing the central orifice 174*a*.

However, in a variant, not represented, the second zone may be divided into several sub-zones each comprising a hollow portion in the casing and which is filled with the flexible and elastic material.

The second zone may thus be discontinuous.

The material may thus for example have the consistency of a gum used in paper making or indeed adopt a more flexible consistency according to need.

As represented in FIG. 11, the second zone comprises, delimited by an annular wall 174*b* internal to the body 174 and surrounding the central part 174*c* where the locking means are housed, an annular space which is filled with the flexible and elastic material. The body 174 also encloses an annular chamber 178 surrounding the material filled annular space. This chamber 178 comprises for example one or more members such as the member 23 of FIG. 9 with shapes suited to the geometry of the chamber.

As represented in FIG. 2, the decoupler comprises electromagnetic detection means 110 mounted on the hood 100 and which are able to detect an unlocked position of the two elements 22, 24 of the antitheft device fixed to one another (e.g.: FIGS. 10A, 10C and 11).

These electromagnetic detection means 110 comprise means for emitting an electromagnetic signal and means for receiving said electromagnetic signal emitted. The emitting means and the receiving means are disposed in a peripheral zone of the decoupler 12 surrounding the unlocking zone and therefore the housing 30. More particularly, the emitting means and the receiving means comprise several pairs of emitting elements and of receiving elements. The emitting elements of a pair being disposed opposite the receiving elements of the same pair.

FIG. 12 illustrates viewed from above electromagnetic detection means 110 of the decoupler which are arranged in a first configuration around the housing 30 of the unlocking zone (the other details of the decoupler have not been represented for the sake of simplification). An antitheft device 20 has been positioned in the housing 30 of the decoupler.

Four pairs of emitting elements and of receiving elements (112*a*, 112*b*), (114*a*, 114*b*), (116*a*, 116*b*) and (118*a*, 118*b*) are disposed around the central housing 30 on the edges of a square or rectangle. The pairs are grouped two by two so that the emitting elements of two grouped pairs are disposed in an adjacent manner, just as for the receiving elements. This arrangement makes it possible to prevent the electromagnetic signals or beams emitted on one side of the square or rectangle from being able to interfere with the electromagnetic signals or beams emitted on the opposite side. Thus, the emitting elements 112*a* are disposed alongside the emitting elements 114*a* (on the same side of the square or rectangle) and, facing this (on the opposite side), the receiving elements 112*b* are disposed alongside the receiving elements 114*b*. The same holds for the emitting elements 116*a*, 118*a* and the receiving elements 116*b*, 118*b* of the other two pairs.

For example the emitting elements and the receiving elements are optical elements and, more particularly, optical cells such as light-emitting diodes (Led) which ensure, in the one case, the function of emitting a light beam (e.g.: infra-red) and, in the other case, the function of receiving the beam.

By way of variant, diodes are used which each ensure both the emitting and the receiving function.

For example, the emitting elements and the receiving elements are optical sensors each formed of a plurality of optical fibers arranged according to a horizontal flattened bundle of fibers (fan shape) which is encapsulated in a casing. The fibers join up on exit from the casing as a single stretch of optical fibers which is attached to an amplifier. Each optical fiber bundle housed in a casing can be emitting or receiving. One and the same amplifier can be used either with an emitting bundle or with a receiving bundle and has for this purpose two TX and RX input/output and an input/output for an electrical signal.

Thus, an amplifier receives as input an electrical signal (generated by the unit 18 of FIG. 1A) which is converted into an optical signal exiting through the TX output and transmitted to an emitting bundle. Conversely, a receiving bundle receives the optical beam emitted (for example in visible light) and which has been affected by the presence of an identification device 20 in the axial locking position or in the shifted position. The received beam is transmitted to an amplifier on its RX input, is recomposed and converted into an electrical signal so as to be dispatched to processing means of the unit 18.

The sensors used are for example marketed by the company Balluff under the commercial reference D25. The wavelength of the radiation emitted is 660 nm and the width of the beam emitted is 27 mm.

FIG. 13 illustrates the arrangement of the electromagnetic detection means of FIG. 12 with the two elements 22, 24 of an antitheft device fixed to one another in an unlocked position (the device has previously been unlocked). The second element 24 is in the housing 30, while the first element is fixed in a shifted manner in the second element according to one of the embodiments of FIGS. 10A-C and 11.

To be able to detect the unlocked position of FIG. 13 several procedures are possible.

According to a first procedure, measurements (calibration) are carried out previously on the basis of the locked axial position of FIG. 12 for each of the pairs of emitting and receiving elements. The electromagnetic signals or beams emitted by the emitting elements of each pair are thus received and measured (for example the amplitude is measured) by the receiving elements of one and the same pair. These signals or their amplitude are recorded by the processing system 18 of the decoupler.

When the antitheft device is in the position of FIG. 13, the emitting and receiving elements are activated so as to emit and receive signals or beams. The propagation of these latter from the emitting elements of a pair to the receiving elements of the same pair is affected by the presence of the shifted device in a different manner than for FIG. 12 with the unshifted device. The signals or beams received are then compared with those recorded previously (or only their amplitude after measurement) and the comparison makes it possible to determine the presence of a shifted configuration of the antitheft device.

According to another procedure, measurements (calibration) are carried out previously on the basis of the locked axial position of FIG. 12 and on the basis of all the possible shifted positions (such as that of FIG. 13) of the two elements with respect to one another. Moreover, measurements are made, for each shifted position, with the first element 22 in various angular orientations (0°, 90°, 180° and 270°). The set of four curves of values obtained with the four pairs of emitting and receiving elements for the set of positions defined hereinabove are illustrated in FIG. 14. Each curve is obtained for ones of the four pairs of elements.

This set of curves makes it possible, by comparison with the value or values obtained for an unlocked position of an antitheft device, to detect this position and, even, to be able to determine for example the opening (O1 to O5) of FIG. 10B into which the tip 22*a* of the first element 22 is inserted.

FIG. 15 illustrates viewed from above electromagnetic detection means 120 for the decoupler which are arranged in a second configuration around the housing 30 of the unlocking zone of the decoupler. The electromagnetic detection means 120 are represented mounted on the hood 100 of the decoupler around the opening 100*a* which leaves visible the ring 46 and the blocking members 70, 72 bordering the opening of the housing 30.

No antitheft device has been positioned in the housing 30.

The detection means are also arranged by pairs of emitting elements and of receiving elements (122*a*, 122*b*), (124*a*, 124*b*), (126*a*, 126*b*) disposed around the central housing 30 and opposite one another within one and the same pair. In this example three pairs are enumerated, thereby making it possible to reduce the overall cost of the whole of the decoupler electromagnetic detection means.

The pairs are arranged in such a way that the set of middle axes of the electromagnetic signals or beams emitted by the emitting elements of the various pairs define a triangular region (FIG. 15) inside which is inscribed the housing of the unlocking zone. The first two pairs (122*a*, 122*b*), (124*a*, 124*b*) are disposed in a cross so as to leave, on one and the same side of the cross, sufficient lateral space between the two elements 122*a*, 124*a* of the two pairs to create a passage P for the intake of an antitheft device to be unlocked (in the direction indicated by the arrow A). This passage left free facilitates the manipulation and the intake of the antitheft devices into their unlocking housing.

On the opposite side of the cross, the adjacent elements 122*b*, 124*b* are on the other hand disposed alongside one another for bulkiness reasons, in particular because of the edge 100*b* of the hood 100 (opposite to the edge 100*c* by which the devices are introduced into/taken in to the unlocking zone.

The pairs of elements (122*a*, 122*b*) and (124*a*, 124*b*) are inclined by about 30° (for example 33°) with respect to the direction of intake A or with respect to the opposite edges 100*d*, 100*e* of the hood. Their middle beams are tangent to the housing 30 in the bottom part in FIG. 15.

The third pair (126*a*, 126*b*) is shifted (upwards in FIG. 15) toward the adjacent elements 122*a*, 124*a* bracketing the entrance passage P into the unlocking zone. The emitting and receiving elements of this pair are disposed parallel to the opposite edges 100*d*, 100*e* of the hood and its middle beam is tangent to the housing in the top part.

This arrangement (principle of triangulation) is particularly sensitive and allows better detection of the locked central position of the antitheft device (like that of FIG. 12). This arrangement is also more sensitive than the arrangement of FIGS. 12 and 13 for detecting in a precise manner one of the unlocked positions of the antitheft device from among a plurality of unlocked positions.

It will be noted that the reader 29 of FIG. 1A is illustrated dashed in the passage P. This reader can be integrated into the decoupler and disposed wall flush or proud with respect to the hood 100 without this encumbering the intake motion for entry into the unlocking zone (along the arrow A) of a device 20 fixed to a commercial article.

The identification device 20 is for example equipped with at least one RFID member 25 such as a circuit fitted with a memory chip and which possesses in memory an TID identifier (the acronym standing for "Transponder ID"), a part of which is unique and unmodifiable. The RFID member 25 is housed inside the device as represented schematically in FIG. 9, for example in the head 22 (first element) and is therefore inaccessible from the exterior. This operation is performed during the fabrication of the device. Alternatively, an RFID member can be integrated into each of the two elements 22, 24. An RFID member uniquely identifies the device 20. If each element 22, 24 carries an RFID member, the latter uniquely identifies the element concerned, thereby making it possible to avoid errors of assembly.

Commercial articles are generally identified in a unique manner by a commercial article code termed the EAN code ("European Article Number", generally 13-digit codes). For example, a size T3 green polo shirt is identified by a unique EAN code but not the physical object itself. Thus, several copies of this commercial article which are available in one and the same shop will all bear the same EAN code, which does not therefore make it possible to identify several distinct physical objects which correspond to the same commercial article identified by one and the same EAN code.

A label is generally attached to the physical object on sale in a shop. This label bears the price of the article/physical object and a barcode (one-dimensional optically read code) which is representative of the EAN code assigned to the article. Another physical object corresponding to the same commercial article (e.g.: size T3 green polo shirt) bears a label with an identical barcode and an identical price.

A portable apparatus, known per se (for example a Motorola MC 3190 apparatus), which is capable of reading the barcodes of the labels of the articles and of programming the RFID chips of antitheft devices is used to read the barcode of the label borne by the article. This apparatus is connected to the computing system (database/computing server 16 and checkout till computer 14), thereby making it possible, by reading the barcode, to recover the EAN article code which, in the computing system, represents the commercial article (description, size, brand, color, price, etc.).

The apparatus is thereafter used to program or encode the memory of the RFID chip 25, that is to say the EAN code identifying the commercial article/physical object to which the antitheft device is fixed is registered in the RFID member where it is associated with the TID code.

The aforementioned portable apparatus is also used to read the identifier or TID code registered in the memory of the RFID chip 25 and, thus, associate it with the EAN article code. The (temporary) association between the EAN code and the TID code makes it possible to uniquely identify the antitheft device-commercial article/physical object pair, and therefore the physical object itself.

This association is recorded, via the portable apparatus, in the aforementioned computing system (database/computing server 16 and checkout till computer 14).

The head 22 of the device 20 comprises a transparent protection interface 22*b* (glass pane, plastic film, etc.) behind which may be disposed, in a manner as to be readable from outside the device, one or more optical-reading codes 22*f* and optionally information 22*e* which is carried for example by one and the same support 22*c* in FIG. 16 (e.g.: printed disk or roundel made of paper, plastic, cardboard . . . or support forming an integral part of the head), for example encapsulated in the device inside the housing 22*d*. According to a variant, the optical code is on the transparent protection interface itself or inside the latter (in its thickness), or indeed at some other location on the head 22 (in case of necessity the head may be modified; for example the surface area of the transparent protection interface can be reduced and the optical code is carried by a zone of the head situated alongside the interface. According to another variant, the optical-reading code or codes are carried by the body 24 (second element). This or these optical codes are integrated into the antitheft device during the fabrication of the latter. Thus, the optical code is associated with the TID code or identifier even before the antitheft device is locked to an article/physical object and before an EAN commercial article code is associated with the device. This association is recorded in memory of a computing system which may be the aforementioned computing system (FIG. 1A) or a different system. It will be noted that the presence of the transparent protection interface is not indispensable and the optical code can be fitted out at any location visible from outside the head. Preferably, the optical code is inaccessible from outside the device if it is desired to prevent its possible degradation, modification or deletion.

The optical code is representative of information (distinct from the information 22*e* aimed at hereinabove) uniquely identifying the commercial article to which the identification device is fixed in a locked manner. Thus, the presence of the optical code in the identification device renders the identification of this article secure. The optical-reading code is distinct from the EAN commercial article code.

By way of variant, one of the two elements of the device 20 bears an RFID member and the other an optical-reading code such as described hereinabove, thereby avoiding having to manage two RFID members and two different TID identifiers.

The optical-reading code is for example a two-dimensional code and, for example, a code of so-called Quick Response (QR) type, also known by the name "flashcode". An exemplary embodiment illustrated in FIG. 16 shows a zone bearing printed information glued on the support 22*c* of the head 22 as well as a two-dimensional optical-reading code 22*f*, subsequently denoted QR1.

The optical-reading code (intermediate code serving as customer interface) incorporates a string of alphanumeric characters which is able to be read and decoded by a software application executable on an electronic communication apparatus, for example portable (and therefore mobile), that can be carried by a user, such as a portable telephone of smartphone type. Alternatively, the apparatus can be a touchpad tablet, a webcam, etc.

Several versions of QR code can be used and in particular: version 1-21x21, 6 to 25 alphanumeric characters; version 2-25x25, 20 to 47 alphanumeric characters, . . . , version 10-57x57, 174 to 375 alphanumeric characters, version 40-177x177, 1253 to 4296 alphanumeric characters. By way of example, the QR code possesses a print size of 7.4 mm×7.4 mm and is a version 1 QR code with a correction or redundancy rate of 25%, that can represent a string of alphanumeric characters (from 0 to 9 and from A to Z). Such a code is correctly readable by a user whose reading apparatus (electronic communication apparatus) is placed some thirty or so centimeters from the code. It will be noted that other two-dimensional optical-reading codes (e.g.: codes of Datamatrix and Aztec type) can be used alternatively or in addition to a QR code. For the sake of simplification, the QR code can be designed independently of the TID identifier of the antitheft device. However, the code QR1 may be partially or totally linked with the TID code. Indeed, the optical code QR1 may be generated on the basis of the code TID1, by using all or part of this code.

The electronic communication apparatus is equipped with an application for reading (and decoding) the optical code (the application can also be downloaded previously) and an Internet browser. By bringing the communication apparatus thus equipped close to the device 20, the user can therefore, after having launched the reading application, sight the optical code 22*f* with the camera and capture the image of the optical code. The code 22*f* has been designed to represent, for example, the URL address of an Internet site or of a Web page dedicated to the commercial article. The decoding of the code by the application permits directly (e.g.: via a connection of SSL type), in an automatic and secure manner, Internet connection with the site or the page hosted on a server and therefore the display of the site or page concerned on the screen of the apparatus. The user of the apparatus has information about the commercial article in the guise of commercial article (features of the article, available sizes and colors, accessories that can be used with the article, price, information about the brand under which the article is offered for sale, etc.) and also has information about the article in the guise of physical object since it is possible to ascertain the number of physical objects in stock by selecting one or more icons concerned. The on-line purchase of the object/the article (captured by the apparatus on the basis of the optical code) which is in front of the user is possible by way of his apparatus. The user can also, if he so desires, go to a payment terminal of the shop to make the payment.

The QR optical code of the antitheft device is thus associated/linked (temporarily) with the URL address of the site corresponding to the commercial article/physical object to which the device is fixed in a locked manner. Therefore, the TID code or identifier is also associated/linked (temporarily) with this URL address.

FIG. 17 illustrates an example of associations between the various codes and information presented hereinabove.

Thus, a memory area Z1 of a computing system (for example different from the system of FIG. 1 but with which it can communicate) contains an association table T1 in which the TID and QR codes are mutually associated. Right from the fabrication of the antitheft device, these two codes are associated and recorded in the table T1 but the URL address is not present therein since no article is yet associated with the antitheft device. When the device is subsequently assigned to a commercial article, the association of the TID and QR codes with the URL address of the site corresponding to the article concerned will be recorded in this table. Other information is also recorded in this table such as for example the shop where the object/the article is offered for transaction, information relating to the various readings of the optical codes of the antitheft devices fixed to the physical objects and which are performed by different users, such as the date and the various actions undertaken by the user in relation to the optical code concerned. When the user interacts with the QR optical-reading code of the antitheft device, the software application connects in a secure manner to this memory area Z1 and interrogates the table T1 on the basis of the string of alphanumeric characters of the optical code.

A memory area Z2 of the computing system of FIG. 1A (computing system of the shop) contains an association table T2 in which the TID and EAN codes are associated with one another and with the URL address of the site corresponding to the article concerned.

It will be noted that the TID/URL association which is generally created in the shop where the article/object is on sale (during the assignment of the antitheft device to a commercial article) is transferred in a secure manner to the table T1 of the area Z1 in which it is recorded. The TID and QR codes are thus linked in a temporary manner with the URL address.

The device 20 is put in place on the commercial article (physical object) 26 (FIG. 1A) to be identified and optionally to be protected against theft and which bears a label furnished with a barcode representative of the EAN commercial article code (for example EAN1) stored in the computing system of the shop.

The codes TID1 and QR1 make it possible to read and therefore to identify the physical object 26 in a unique, definite and secure manner, according to two different reading techniques, independently of a poor reading of the barcode, or of a reading of an erroneous barcode as a consequence of a substitution of the label, either by error, or in an ill-intentioned manner. Loss of earnings resulting from US is thus greatly limited.

FIG. 18 is an algorithm representing the main steps of a method for managing the unlocking of an identification device of an article, in particular an antitheft device 20, according to a first embodiment of the invention. This method is implemented during the passage of a commercial article 26 at a point of sale 14 of a shop with a view to performing a commercial transaction (FIGS. 1A to 1D). An antitheft device 20 has previously been fixed to the article in a locked manner as explained hereinabove. This algorithm will also be described with reference to other figures. It will be noted that certain portions of this algorithm correspond to portions of software code which can form part of a piece of software executed by the decoupler 12 and/or the POS 14.

The algorithm comprises a first step S0 of waiting of an antitheft device in the decoupler receiving zone 28.

The second step S1 is a test step aimed at detecting the presence of an antitheft device near the receiving zone. The reading device 29 is able to detect the presence of one or more devices 20 in proximity to this zone.

In case of device non-detection, step S0 is executed again, otherwise we go to the following steps S2 and S3.

It will be noted that in this first embodiment the means (70, 72) for preventing access to the decoupler receiving/unlocking zone are activated permanently (deployed position) so as to obstruct the opening allowing access to the housing 30, as represented schematically in FIG. 19. The detected device 20 cannot therefore be disposed in the receiving/unlocking zone without these means having previously been deactivated. In the waiting position of FIG. 19 the mobile peripheral part 40 of the decoupler is in the top blocking position such as represented in FIGS. 2 and 3.

In the course of steps S2 and S3, the detection is undertaken of possible other antitheft devices in proximity to the receiving zone and the reading of which could disturb the unlocking operations and the subsequent operations (subsequent malfunction). This detection is performed by the reading device 29 which is suitable for reading the TID identifiers of the RFID members (RFID chips) disposed in a given solid angle dependent on the reading device 29. The angle can be adjusted so as to be as small as possible and thus to emit radiofrequencies in a restricted space. This detection step offers further security which makes it possible to ensure that one antitheft device will not be identified instead of another.

If the radiofrequency field emitted by the device 29 excites the antennas of other antitheft devices situated in proximity (for example devices arising from previous transactions and not put away by the shop staff), as illustrated in FIG. 20, the device 29 detects the presence of several antitheft devices and the test step S3 leads to the triggering of a sound and/or visual alarm (S4) warning the checkout operator of the situation.

The hood 32 of the decoupler can comprise telltale lights (not represented) which, when they light up, are representative of the triggering of an alarm. According to the type of alarm one or the other of the telltales lights up. The device 20 which had been detected initially step S1) must then be withdrawn from the proximity of the decoupler (in any event from the reading field of the reading device 29) and step S2 is executed again.

Alternatively, presence detectors (not represented in FIG. 1A but for example RFID readers) arranged around the decoupler or at the periphery of the latter make it possible to detect the presence of one or more other devices in proximity to the decoupler 12 and, in particular, its receiving zone (although the reading device 29 has detected the presence of the device 20 on approach to the receiving zone).

If no other antitheft device is detected (whether by the reading device 29 or by the presence detectors mentioned hereinabove), the test step S3 is followed by step S5 of reading the identification information of the device 20 placed in front of the reader 29. In the course of this step, the reading device 29 undertakes a first reading of the TID-EAN association recorded in the memory of the RFID chip 25 (the TID identifier can also be read individually).

The following step S6 is a step of storing in a buffer memory of the system 18 of the decoupler identification information read at the previous step (optionally storing other information associated therewith). This read information can be transmitted to the computing system of the shop.

The following step S7 makes it possible to indicate (by a luminous and/or sound signal) whether the operation has indeed been performed and if no anomaly (resulting for example from the reading step) has been detected, for example as a function of the information retained by the system.

The following step S8 is a test step making it possible to determine whether there remain antitheft devices 20 to be read (this being the case if the customer goes to the checkout till with several articles to which devices 20 are respectively fixed).

If other devices must be read, step S8 is followed by step S0 already described.

Otherwise, step S8 is followed by the start of transaction step S9 (payment for the commercial articles whose antitheft devices 20 have been read).

The following step S10 is a test step as regards the validation of the payment.

If the payment is not validated (for example because the customer has changed his mind or else because the latter is denied a credit card payment authorization), step S10 is followed by the test step S11. This test step verifies whether the operation in progress must be canceled or not.

If the transaction is canceled, step S11 is followed by the waiting step S0.

Otherwise, step S11 is followed by steps S9 and S10 already described.

If the payment is validated, step S10 is followed by two respective waiting and test steps S12 and S13 identical to the waiting step S0 and test step S1.

In case of non-detection of the presence of an antitheft device 20, step S13 is followed by step S12.

In case of detection of the presence of an antitheft device 20 the device 29 undertakes, in the following step S14, the reading of the identification information borne by the device 20. This is a second reading, the first reading having already been carried out in step S5.

During this step the information read is compared with the previous information which had been read and stored. If the information corresponds this signifies that it is the same device 20 which is presented once again to the reader 29. During this step it is verified whether the payment for the article to which the device is fixed has been validated (steps S9 and S10).

The test step S14 is then followed by step S15.

If it is not the same device or if the article has not been paid for, step S14 is followed by a step S14' of triggering a visual and/or sound alarm before returning to the test step S13 already described.

Passage from step S14 to step S15 decides to permit the deactivation of the means for preventing access to the unlocking zone 28. The mechanical members (70, 72) which at least partially obstruct access to the zone and therefore to the housing 30 are deactivated and are thus retracted into their eclipsed stowage position. The entrance of the housing 30 is then free for access as illustrated in FIG. 21. The peripheral part 40 of the decoupler is still in the top position (FIGS. 2 and 3).

The antitheft device 20 (more particularly the body 24) can then be placed in the housing 30 of the decoupler such as represented schematically in FIG. 1D. As explained with reference to FIG. 8, under the magnetic attraction the assembly of the stabilizer 31 and of the device 20 descends into contact with the unlocking surface 36*a*. Automatic unlocking of the two elements 22 and 24 with respect to one another is performed. The first element 22 (head) is withdrawn and the commercial article 26 is freed as illustrated schematically in FIG. 22.

It will be noted that after unlocking, the second element 24 remains in the housing 30 with the peripheral part 40 of the decoupler still in the top position. Thus, the upper surface of the second element is set back with respect to the upper surface of the ring 46 of the peripheral part 40. It is therefore not easy to withdraw the second element from its housing whose shapes it hugs.

The following step S16 is a test step which makes it possible to verify that the second element 24 is positioned in the housing. This test is carried out by way of the contact sensors 90 of FIG. 8.

The detection of the presence of the second element 24 of the device 20 in the unlocking zone leads to the following step S17.

In the course of this step the blocking members 70, 72 are activated so as to yet more reliably block the second element 24 in the housing. These members are then deployed so as to partially close the opening for access to the housing above the second element 24, as illustrated in a magnified manner in FIG. 8. The members 70, 72 thus hold the second element 24 captive in the housing 30. The peripheral part 40 of the decoupler is still in the top position.

In the course of the following step S18, the first element 22 of the device 20 which has previously been withdrawn, in the direction of intake A (see FIG. 15), toward the unlocking zone where the second element is held 24 (FIG. 23), is brought back in front of the reading device 29.

Step S18 then envisages a third step of reading the identification information borne by the first element 22.

In the course of the following step S19, the first element 22 is assembled/fixed temporarily (in an unlocked position) with the second element 24 blocked in the decoupler receiving zone. Accordingly, use is made of one of the means described with reference to FIGS. 10A-C and 11 and which make it possible to obtain a configuration shifted transversely between the two elements with respect to the axial locking configuration of FIGS. 9, 10A (axial central position L), 19 and 21.

FIG. 24 illustrates in a very schematic manner, viewed from above, the positioning of the first element 22 on the second element 24 in one of the possible shifted configurations (unlocked position) superimposed on the arrangement of the electromagnetic detection means 122*a*-126*b* of FIG. 15. The members 70, 72 and the ring 46 have not been represented for the sake of simplification. It will be noted that the blocking members 70, 72 are still in the blocking position. However, in a variant, they can be retracted to go to an deblocking position.

In the course of step S19 a test is also undertaken to detect whether the first element 22 brought back is properly placed on the second element 24 (and fixed to the latter in an unlocked manner) in one of the possible shifted configurations.

Accordingly the electromagnetic detection means 122*a*-126*b* already described with reference to FIG. 15 are implemented.

The following step S20 performs a comparison between the information read in step S18 (third reading) and the information read in step S14 (and previously stored in step S6), so as to ensure that the first element 22 is indeed the same as that which was withdrawn at the time of the unlocking of the antitheft device (S15). This verification makes it possible to improve the management of the two elements of each identification or antitheft device since one is thus assured that the same two elements are always paired. If this is not the same first element, an alarm is triggered (S21).

If this is the same first element, the following operations are undertaken thereafter (step S22):

storage in a permanent manner, in a permanent memory of the decoupler 12 and/or in the database 16 of the system, of the information read (TID-EAN association and TID individually) and stored previously (step S6) in a buffer memory; in this manner the information linked with articles which have formed the subject of a commercial transaction are stored in a lasting manner (which was not yet the case in step S6);

erasure of the information of the RFID member 25 (e.g.: erasure of the data of the memory area of the RFID chip), that is to say dissociation of the TID code and of the EAN code so as to be able to put the antitheft device 20 back into circulation in the shop and assign it to a new article (new EAN article code).

In the embodiment which has just been described the QR optical-reading code was not used for the management of the unlocking of the device 20. For this embodiment it is thus for example conceivable that the device 20 does not carry any optical-reading code.

However, in a variant, not represented, the device 20 can integrate such an optical-reading code. This code, even if it is not used for the management of the unlocking of the device 20, was nonetheless able to be used previously, when the user decoded this code so as to access information about the article via the URL address associated with the code. Within the framework of this variant, for the same reasons as before, the QR optical-reading code/TID code is disassociated from the URL link with which it is associated. This dissociation is illustrated in FIG. 17.

The following step S23 provides for deblocking the second element 24. The deblocking occurs here, on the one hand, by deactivating the blocking members 70, 72 (retraction of the members, this being controlled by rotation of the second motor 74 and corresponding rotation of the disk 80; FIGS. 2 and 4) and by controlling the direction of rotation of the first motor 54 in such a way that causes the mobile peripheral part 40 to descend to the bottom deblocking position.

FIG. 25 represents in a schematic and partial manner, in the bottom position, the mobile peripheral part 40 carrying the blocking members 70, 72.

In this position the second element 24 projects proud of the mobile peripheral part 40 and of its blocking members. The second element 24 can thus easily be withdrawn (in the direction of the vertical arrow) by grasping with the fingers the first element 22 to which the second element is fixed in a temporary manner.

The following step S24 provides for ordering the displacement of the peripheral part 40 to the top blocking position and reclosing access to the unlocking zone (partial closing of the opening making it possible to access the housing 30) by again activating the means for preventing unlocking (blocking members 70, 72 deployed).

The following step S25 provides for performing a test so as to verify whether there remain antitheft devices 20 to be unlocked. If such is the case, this step is followed by the waiting step S12 and by the test step S13 that have already been described.

Otherwise, step S26 then terminates the algorithm.

According to a first variant, not represented, during the reading step S5 and the other reading steps only the TID identifier of the device 20 is read. This read information is thereafter transmitted to the terminal 14 which thus retrieves from the server or the database 16 the corresponding TID-EAN association uniquely identifying the commercial article/the physical object.

If this association is not retrieved in the computing system, there is attempted fraud and an alarm is then triggered.

According to a second variant, not represented, use is made of the unique commercial article code EPC (this code uniquely identifies a physical object in the guise of commercial article and can therefore be used instead of the TID-EAN association for this unique identification) that is registered in a volatile memory area of the antitheft device (EPC area) different from the area where the TID code is registered (TID area). The reading of the EPC area is faster than that of the TID area.

This information read (by an appropriate device) is thereafter transmitted to the terminal 14 which thus retrieves the corresponding TID-EPC association (or EAN) from the server/database 16.

According to a third variant, not represented, use is made of the QR optical-reading code borne by the device 20 and which is read by an appropriate device. The identification information thus read is transmitted to the terminal 14 which thus retrieves the corresponding TID-EAN-QR association from the server/database 16.

According to a fourth variant, not represented, a test can be conducted during the execution of the method of FIG. 18 so as to determine whether the same device has already been read recently, namely fewer than a predetermined number of hours ago (e.g.: 24 h). Such a test offers further security in the management method so as to combat frauds internal to the shop. In case of positive test an alarm is triggered.

According to other variants, not represented, the blocking members may totally obstruct access to the housing, may adopt other forms and for example may form a sole blocking member (single hatch in the manner of a flap), or indeed more than two members. The mechanism for displacing the blocking member or members may differ from that set forth with reference to FIGS. 2 and 4.

According to yet another variant, the peripheral part 40 surrounding the mechanical stabilizer and its housing 30 may be fixed, while said mechanical stabilizer and its housing are able to move between a top deblocking position and a bottom blocking position.

The mechanisms for displacing the various mobile components may differ from those represented in the figures.

According to a further variant, the decoupler can comprise, in addition to the means already described, extraction means which facilitate the extraction of the second element from its housing. This may for example be a thrust member or finger which is fitted out in the stabilizer 31 and which is able to deploy on command so as to thrust the second element upwards. For example, the free end of the extraction member has a slope shape or cam shape suited to the exterior profile of the body of the second element (e.g.: spoon shape) so as to come into contact with the latter and to cause its lifting out of the housing.

It will be noted that such a variant can alternatively replace the displacement of the peripheral part 40 or of the stabilizer 31. Thus, the housing is in a lowered position with respect to the ring in which the blocking members are fitted out and only the thrust member or members allow the raising of the second element, the other parts 40 and 31 being fixed.

According to a second embodiment, not represented, the decoupler 12 is free for access to the devices 20. The article to which a device 20 is fixed is settled up by the customer at the payment terminal 14 before or during the unlocking action. The device 20 is thus taken to the decoupler, read by passing in front of the reading device 29 and introduced into the housing of the decoupler. The mobile peripheral part 40 of the decoupler is in the top blocking position. The unlocking of the device 20 occurs automatically and the article is freed, but the second element 24 remains blocked inside the housing by the blocking members 70, 72. These members are activated so as to deploy into the opening for access to the housing and thus prevent any axial withdrawal of the second element, as long as the same first element has not been taken back to the decoupler. One is indeed assured that it is the same first element which is used to extract the second element. The second element is thus freed just as for the previous embodiment.

According to a third embodiment illustrated in FIG. 18, the management method comprises several steps S'1, S'2, S'3 and S'4 which are performed instead of steps S0 to S8 and which intervene before the payment steps S9 to S11. Thereafter, steps S12 to S26 already described for the management of the unlocking of the device 20 so as to avoid frauds and to improve the management of the two constituent separable elements of the device are applied.

In this third mode, the user has a mobile or portable communication apparatus 200 (FIG. 26) such as an intelligent telephone or smartphone. This apparatus is equipped with a screen 202, with an Internet browser and with a software application for reading optical codes such as the QR optical-reading code mentioned hereinabove. The application is previously downloaded via the Internet onto the apparatus 200 and launched by the user.

During step S'1, the user who is in front of the physical object 210 is invited to read (and decode) the optical code Q1 of the antitheft device (or identification device 20). By aiming the camera of the apparatus at the optical code, the image of the code is digitized and thus its decoding is undertaken.

The application connects in a secure manner to the memory area Z1 of FIG. 17 and interrogates the table T1 on the basis of the decoded string of characters of the code QR1, thereby making it possible to identify in a unique and secure manner the physical object/article concerned and the shop. The code QR1 is linked with the code TID1 (step S'2). If no article/TID is identified, step S'2 is followed by step S'1 already described.

The user is identified on the basis of the communication of a user name and of a password via his apparatus and he then has access to his user account. Otherwise, he is not identified and a user account must be created by filling in all the appropriate information making it possible to perform a commercial transaction on-line (personal details ? means of payment, etc.).

The following step (S'3) provides thereafter for establishing an Internet connection between the apparatus 200 and one or more URL addresses dedicated to the article or appertaining to the latter (complementary articles), namely here the address URL3. This link with the URL address is rendered possible because of the association table T1 which links TID1, QR1 and URL3 (Association 1).

The user is thus thereafter directed automatically to this address and he is thus connected with the site or the page 212 hosted on a server 214 which is not necessarily the server 16 of FIG. 1A (it will be noted that the optical code does not incorporate a script which points directly to a URL address since the connection with the URL address is allowed only after the accomplishment of the above steps). This page reveals a window 216 on which the article assigned the article code EAN3 is viewed. The code TID1 is thus associated with a commercial article via its code EAN3. If such is not the case, step S'3 is followed by step S'1 already described.

Thereafter, the user can accomplish various actions on the basis of his apparatus 200 (obtaining complementary information, storage in a selection list 218 with a view to a deferred action such as a deferred purchase, on-line or not, placement/selection of the article identified by the association TID1-EAN3 in a purchase basket 220 with a view to buying it immediately, etc.).

It will be noted that all the actions of code reading by the apparatus and the subsequent actions are recorded in the apparatus, and also in one and/or the other of the computing systems.

In step S'4, the user selects the article/object that he desires to purchase and validates this selection with a view to on-line payment for the latter via his apparatus during the subsequent steps S9 to S11.

The transaction is performed in a secure manner as on numerous Internet sites.

When the article/object has been purchased, the following steps S12 to S26 are performed.

The user then goes to a decoupler 12 to unlock the device 20 therefrom and free the article/object from said device. The information gathered during steps S'1 to S'4 has been transmitted to the decoupler (this information, in particular identification information, is also known to the computing system of the shop which has recorded the payment for the article/object identified by the QR code-EAN code association). As already explained hereinabove, a dissociation (FIG. 17) between the optical code/the TID identifier and the URL address/EAN code corresponding to the article/object must be performed so as to be able to reuse the recently unlocked device 20 with other articles/objects. It is indeed appropriate to ensure that a new article/object fixed to the device will not be associated with an incorrect URL address.

This dissociation is recorded both in the tables T1 and T2 so as on the one hand, to break the link between the various codes and addresses and, on the other hand, to preserve a trace of the dissociations as such with a view to a subsequent use such as the billing of services associated with the multiple use of one and the same device 20.

The erasure of the RFID chip of the device 20 is also performed so as to wipe the TID-EAN link.

It will be noted that the method for managing a transaction and for unlocking according to this third embodiment makes it possible to avoid problems linked with checkout queues since the article/object now merely has to be unlocked at a decoupler without having to go through checkout.

Moreover, this method for managing a transaction reduces checkout errors.

FIGS. 27 to 30 illustrate the cooperation between a decoupler or unlocking device 230 and an exemplary antitheft device 250 according to another embodiment (FIG. 27). In this other embodiment the device 250 is in a single component in which the two elements of the device are clamping members 252, 254 forming claws to clasp the article to be protected. These members are fitted out in a clamping head 253. The device comprises, on the one hand, a clamping mechanism implemented under the action of an actuation member 256 (e.g.: thumbwheel) actuated by a user that exerts a clamping load by rotating the actuation member and, on the other hand, an internal locking mechanism (means) to prevent any subsequent clamping onwards of a predetermined clamping couple exerted by the two members on the article. The actuation member 256 is attached to the head 253 and takes the form of a body 256*a* with which are attached two gripping flanges 256*b*, 256*c* which separate from the body. Such a device is for example of the type of that described in patent application FR 2 942 835.

FIG. 28 illustrates in a schematic and partial manner the upper part of the hood 231 of the decoupler showing the unlocking zone 232 with a housing 233 to receive therein the antitheft device 250.

The housing 233 comprises a central housing zone 233*a*, for example cylindrical, and an adjacent zone 233*b* in the form of a rectilinear trench which is tangent to the central zone. The shape and the dimensions of the housing are suited to those of the device 250. The decoupler 230 comprises blocking members 234 and 235 which are mounted in a manner as to be retractable into recesses fitted out inside two bosses 236, 237 which bracket the central housing zone 233*a*.

Just as for the first embodiment, the blocking members are activated to the blocking position (FIG. 28) so as to prevent the introduction of an antitheft device into the unlocking zone.

The blocking members are deactivated as a function of the same predetermined condition (steps S14 and S15 of FIG. 18) so as to bring them to the retracted position, thus making it possible to let the device enter the housing (FIG. 29). The body 256*a* is housed in the central zone 233*a* and the two flanges 256*b*, 256*c* are positioned in the trench 233*b*.

In a manner identical to step S17 of FIG. 18, the blocking members 234, 235 are again activated after detection of the presence of the device 250 in the housing of the decoupler (FIG. 30). The deployment of the members makes it possible to prevent any withdrawal of the device 250.

It will be noted that the decoupler 230 operates in a manner suited to the antitheft device so as to ensure the unlocking and the freeing of the commercial article during step S15 of FIG. 18.

On the other hand, the management of the two elements of the antitheft device is not relevant in the present embodiment, and the steps of FIG. 18 which are linked with the detection of an unlocked position do not apply.

The invention claimed is:

1. A system for managing the unlocking of an identification device of a packaged or unpackaged commercial article, wherein the system comprises: an identification device of a packaged or unpackaged commercial article, the device comprising at least two elements which are displaceable with respect to one another between two positions, a locked position, in which said at least two elements imprison between them, in a locked manner under the action of a lock, the article or its packaging, and at least one unlocked position, the identification device bearing information identifying said device and/or the commercial article to which said device is fixed, means for identifying the association of the identification device and of the commercial article to which said device is fixed, an unlocking device comprising an unlocking zone and unlocking means for unlocking, with respect to one another, said at least two elements of the identification device and freeing the article or its packaging of said identification device, means for preventing the unlocking of the identification device which are able, on the one hand, to be activated so as to prevent the unlocking of the identification device and, on the other hand, to be deactivated so as to permit the unlocking of the identification device, means for deciding deactivation or non-deactivation of the means for preventing the unlocking of the identification device as a function of the identification or of the absence of identification of the association of the identification device and of the commercial article to which said device is fixed, wherein the means for preventing unlocking are mechanical means which prevent physical access of the identification device to the unlocking zone of the unlocking device, wherein the mechanical means for preventing unlocking comprise one or more mobile blocking members which are able to occupy, on the one hand, a deployed position preventing physical access of the identification device to the unlocking zone of the unlocking device and, on the other hand, a retracted position permitting physical access of the identification device to the unlocking zone of the unlocking device, and wherein the system comprises blocking means which are able to block in a blocking position, in the unlocking zone of the unlocking device, said unlocked identification device or one of said at least two unlocked elements of said identification device, and, the blocking means comprise the mobile blocking member or members of the mechanical means for preventing unlocking, and wherein said system further comprising means for activating and deactivating the means for preventing unlocking, and the means for activating and deactivating the mobile blocking member or members comprise a mechanism for displacing the mobile blocking member or members, and wherein the displacement mechanism comprises a motor cooperating with a toothed wheel for driving the latter in rotation, a component mounted so as to be integral in rotation with the toothed wheel and comprising a contact portion, the mobile member or members cooperating by contact with the contact portion of said component by way of a cam so that the rotation of the wheel drives the displacement of the mobile blocking member or members.

2. The system as claimed in claim 1, wherein said means for activating, in a blocking position, and for deactivating as a function of a predetermined condition, in a deblocking position, the means for blocking the identification device or one of said at least two elements blocked in the unlocking zone.

3. The system as claimed in claim 1, wherein the unlocking zone comprises a housing which is able to receive the identification device or one of said at least two elements and which has a shape and dimensions substantially complementary to those of said device or of the element.

4. The system as claimed in claim 1, wherein the identification device of a commercial article is a device for protection against the theft of this article.

5. The system as claimed in claim 4, wherein the device for protection against theft comprises at least one active or passive member which is able to emit toward the exterior of the device or to receive electromagnetic waves from the exterior.

6. A method for managing the unlocking of an identification device of a packaged or unpackaged commercial article, the device comprising at least two elements which, in a locked position, imprison between them the article or its packaging, characterized in that, the identification device bearing information identifying said device and/or the commercial article to which it is fixed, the method comprises: preventing of unlocking, in an unlocking zone of an unlocking device, of said at least two elements of the identification device with respect to one another, wherein a means for preventing unlocking are mechanical means which prevent physical access of the identification device to the unlocking zone of the unlocking device, identifying of the association of the identification device and of the commercial article to which said device is fixed, deciding of deactivation or non-deactivation of the prevention of the unlocking of the identification device and of freeing of the article or of its packaging as a function of the identification or of the absence of identification of the association of the identification device and of the commercial article to which said device is fixed engaging said mechanical means for preventing unlocking that has one or more mobile blocking members which are able to occupy, on the one hand, a deployed position to prevent physical access of the identification device to the unlocking zone of the unlocking device and, on the other hand, a retracted position permitting physical access of the identification device to the unlocking zone of the unlocking device, and engaging a blocking means to block, in its blocking position, in the unlocking zone of the unlocking device, the unlocked identification device or one of said at least two unlocked elements of said identification device, and, where the blocking means has the mobile blocking member or members of the mechanical means for preventing unlocking, and activating and deactivating the means for preventing unlocking using a means for activating and deactivating that has the mobile blocking member or members having a mechanism for displacing the mobile blocking member or members, and displacing the mobile blocking member or members with the displacement mechanism that has a motor cooperating with a toothed wheel for driving the latter in rotation, a component mounted so as to be integral in rotation with the toothed wheel and comprising a contact portion, the mobile member or members cooperating by contact with the contact portion of said component by way of a cam so that the rotation of the wheel drives the displacement of the mobile blocking member or members.

7. The method as claimed in claim 6, wherein the prevention of unlocking is a prevention of physical access of the identification device to the unlocking zone of the unlocking device.

8. The method as claimed in claim 6, wherein the step of activating the prevention of unlocking comprises a step of deploying one or more mobile blocking members in a deployed position preventing physical access of the identification device to the unlocking zone of the unlocking device.

9. The method as claimed in claim 6, wherein said step of blocking, in the unlocking zone of the unlocking device, the identification device or one of said at least two elements in such a way that, after unlocking of said at least two elements and freeing of the article or of its packaging, said device or one of said at least two elements is blocked in said unlocking zone.

10. The method as claimed in claim 9, wherein it comprises a step of deblocking the identification device or one of said at least two elements blocked in the unlocking zone as a function of a predetermined condition.

11. The method as claimed in claim 6, wherein, the unlocking device comprising a mobile part surrounding the unlocking zone, the method comprises a step of displacing the mobile part between, on the one hand, a high blocking position in which the mobile part is situated at a height above or equal to the height of the identification device or of one of said at least two elements disposed in said unlocking zone and, on the other hand, a low deblocking position in which the mobile part is situated at a height below the height of the identification device or of the element disposed in said unlocking zone.

12. The method as claimed in claim 6, wherein the identification device of a commercial article is a device for protection against the theft of this article.

13. The method as claimed in claim 12, wherein the device for protection against theft comprises at least one active or passive member which is able to emit toward the exterior of the device or to receive electromagnetic waves from the exterior.

14. A system for managing the unlocking of an identification device of a packaged or unpackaged commercial article, wherein the system comprises: an identification device of a packaged or unpackaged commercial article, the device comprising at least two elements which are displaceable with respect to one another between two positions, a locked position, in which said at least two elements imprison between them, in a locked manner under the action of a lock, the article or its packaging, and at least one unlocked position, the identification device bearing information identifying said device and/or the commercial article to which said device is fixed, means for identifying the association of the identification device and of the commercial article to which said device is fixed, an unlocking device comprising an unlocking zone and, in said zone: unlocking means for unlocking, with respect to one another, said at least two elements of the identification device and freeing the article or its packaging of said identification device, blocking means which are able to be activated so as to block at least one of the two elements from being removed from the unlocking device, after unlocking of the latter with respect to one another and freeing of the article or of its packaging, said blocking means being able to be deactivated as a function of the realization of a predetermined condition wherein said at least two elements of the identification device are two separable elements which are able to be fixed to one another, on the one hand, in the locked position and, on the other hand, in said at least one unlocked position, wherein the blocking means are able to be deactivated or not as a function of the identification information borne by one of the two elements when the two separable elements are in said at least one unlocked position.

15. The system as claimed in claim 14, wherein the two separable elements are able to be fixed to one another, on the one hand, in the locked position in which they are arranged opposite one another according to an axial configuration and, on the other hand, in said at least one unlocked position for which they are arranged according to at least one configuration shifted transversely with respect to the axial locking configuration.

16. The system as claimed in claim 14, wherein a first of the two elements comprises a tip intended to pass through the article or its packaging, the second element being provided, in a first zone, with an orifice so as to insert axially thereinto, according to a first insertion axis, the tip and maintain it, under the action of a locking means, in the locked axial position so as to prevent its withdrawal, the second element also being provided with at least one second zone for receiving the tip which is shifted transversely with respect to the first zone and in which the tip is able to be inserted axially according to several insertion axes parallel to the first insertion axis, so as to obtain several distinct possible unlocked positions of the two elements, each unlocked position corresponding to a transversely shifted configuration of said two elements.

17. The system as claimed in claim 14, wherein the unlocking zone comprises a housing which is able to receive the identification device or one of said at least two elements and which has a shape and dimensions substantially complementary to those of said device or of the element.

18. The system as claimed in claim 14, wherein the identification device of a commercial article is a device for protection against the theft of this article.

19. The system as claimed in claim 18, wherein the device for protection against theft comprises at least one active or passive member which is able to emit toward the exterior of the device or to receive electromagnetic waves from the exterior.

20. A method for managing the unlocking of an identification device of a packaged or unpackaged commercial article, the device comprising at least two elements which are displaceable with respect to one another between two positions, a locked position, in which said at least two elements imprison between them, in a locked manner under the action of a lock, the article or its packaging, and at least one unlocked position, the identification device bearing information identifying said device and/or the commercial article to which said device is fixed, wherein the method comprises:

identifying of the association of the identification device and of the commercial article to which said device is fixed, unlocking, in an unlocking zone of an unlocking device, of said at least two elements of the identification device with respect to one another and the freeing of the article or of its packaging of said identification device, wherein said at least two elements of the identification device are two separable elements which are able to be fixed to one another, on the one hand, in the locked position and, on the other hand, in said at least one unlocked position, blocking, in the unlocking zone, of at least one of the two elements after their unlocking and freeing of the article or of its packaging, preventing said at least one of the two elements from being removed from the unlocking device, deblocking of said blocked element of said at least one of the two elements as a function of the realization of a predetermined condition, wherein the blocking means are able to be deactivated or not as a function of the identification information borne by one of the two elements when the two separable elements are in said at least one unlocked position.

21. A system for managing the unlocking of an identification device of a packaged or unpackaged commercial article, wherein the system comprises: an identification device of a packaged or unpackaged commercial article, the device comprising at least two elements which are displaceable with respect to one another between two positions, a locked position, in which said at least two elements imprison between them, in a locked manner under the action of a lock, the article or its packaging, and at least one unlocked position, the identification device bearing information identifying said device and/or the commercial article to which said device is fixed, means for identifying the association of the identification device and of the commercial article to which said device is fixed, an unlocking device comprising an unlocking zone and unlocking means for unlocking, with respect to one another, said at least two elements of the identification device and freeing the article or its packaging of said identification device, means for preventing the unlocking of the identification device which are able, on the one hand, to be activated so as to prevent the unlocking of the identification device and, on the other hand, to be deactivated so as to permit the unlocking of the identification device, means for deciding deactivation or non-deactivation of the means for preventing the unlocking of the identification device as a function of the identification or of the absence of identification of the association of the identification device and of the commercial article to which said device is fixed, wherein the means for preventing unlocking are mechanical means which prevent physical access of the identification device to the unlocking zone of the unlocking device, wherein the unlocking device comprises a mobile part surrounding the unlocking zone and which is able to occupy two positions, namely a high blocking position in which the mobile part is situated at a height above or equal to the height of the identification device or of one of said at least two elements disposed in said unlocking zone and a low deblocking position in which the mobile part is situated at a height below the height of the identification device or of the element disposed in said unlocking zone, and wherein the system comprises a mechanism for displacing the mobile part which is able to be activated as a function of a predetermined condition, and wherein the mechanism for displacing the mobile part comprises a motor cooperating with a toothed wheel for driving the latter in rotation, a component mounted so as to be integral in rotation with the toothed wheel and comprising a first cam, the mobile part comprising a second cam complementary to the first cam and cooperating with said component by way of the two cam so that the rotation of the wheel drives the vertical displacement of the mobile part from one position to the other.

22. A method for managing the unlocking of an identification device of a packaged or unpackaged commercial article, the device comprising at least two elements which, in a locked position, imprison between them the article or its packaging, characterized in that, the identification device bearing information identifying said device and/or the commercial article to which it is fixed, the method comprises: preventing of the unlocking, in an unlocking zone of an unlocking device, of said at least two elements of the identification device with respect to one another, wherein a means for preventing unlocking are mechanical means which prevent physical access of the identification device to the unlocking zone of the unlocking device, identifying of the association of the identification device and of the commercial article to which said device is fixed, deciding of deactivation or non-deactivation of the prevention of the unlocking of the identification device and of freeing of the article or of its packaging as a function of the identification or of the absence of identification of the association of the identification device and of the commercial article to which said device is fixed, engaging the unlocking device comprises a mobile part surrounding the unlocking zone and which is able to occupy two positions, namely a high blocking position in which the mobile part is situated at a height above or equal to the height of the identification device or of one of said at least two elements disposed in said unlocking zone and a low deblocking position in which the mobile part is situated at a height below the height of the identification device or of the element disposed in said unlocking zone, activating a mechanism for displacing the mobile part as a function of a predetermined condition, and vertically displacing the mobile part via a mechanism that comprises a motor cooperating with a toothed wheel for driving the latter in rotation, a component mounted so as to be integral in rotation with the toothed wheel and comprising a first cam, the mobile part comprising a second cam complementary to the first cam and cooperating with said component by way of the two cam so that the rotation of the wheel drives the vertical displacement of the mobile part from one position to the other.

* * * * *